US011773838B2

(12) United States Patent
Tamura et al.

(10) Patent No.: US 11,773,838 B2
(45) Date of Patent: Oct. 3, 2023

(54) COMPRESSOR, REFRIGERANT COMPRESSING APPARATUS, AND REFRIGERATING APPARATUS

(71) Applicant: Mitsubishi Electric Corporation, Tokyo (JP)

(72) Inventors: Yuki Tamura, Tokyo (JP); Shuhei Koyama, Tokyo (JP); Takashi Ishigaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 413 days.

(21) Appl. No.: 15/779,976

(22) PCT Filed: Feb. 2, 2016

(86) PCT No.: PCT/JP2016/053061
§ 371 (c)(1),
(2) Date: May 30, 2018

(87) PCT Pub. No.: WO2017/134742
PCT Pub. Date: Aug. 10, 2017

(65) Prior Publication Data
US 2018/0347556 A1 Dec. 6, 2018

(51) Int. Cl.
*F04B 39/02* (2006.01)
*F04C 28/28* (2006.01)
(Continued)

(52) U.S. Cl.
CPC ..... *F04B 39/0261* (2013.01); *F04B 39/02* (2013.01); *F04B 39/0207* (2013.01);
(Continued)

(58) Field of Classification Search
CPC .. F04B 39/0261; F04B 39/02; F04B 39/0207; F04B 39/023; F04C 23/008;
(Continued)

(56) References Cited

U.S. PATENT DOCUMENTS 8,733,116 B2 * 5/2014 Won ..... F04B 39/0207 62/193
9,518,855 B2 * 12/2016 Lee ..... F04B 39/0207
(Continued)

FOREIGN PATENT DOCUMENTS

JP H04-241797 A 8/1992
JP H05-209591 A 8/1993
(Continued)

OTHER PUBLICATIONS

International Search Report of the International Searching Authority dated Apr. 26, 2016 for the corresponding International application No. PCT/JP2016/053061 (and English translation).
(Continued)

*Primary Examiner* — Charles G Freay
*Assistant Examiner* — Lilya Pekarskaya
(74) *Attorney, Agent, or Firm* — POSZ LAW GROUP, PLC

(57) ABSTRACT

A compressor includes a compression mechanism that compresses refrigerant, and an electromotive mechanism that drives the compression mechanism. A shell accommodates the compression mechanism and the electromotive mechanism, with a reservoir inside the shell and that stores mixed liquid including liquid refrigerant and refrigerating machine oil. An electrode is provided inside the reservoir and faces an inner surface of the shell.

18 Claims, 10 Drawing Sheets

(51) Int. Cl.

| | |
|---|---|
| ***F04C 23/00*** | (2006.01) |
| ***F04C 29/02*** | (2006.01) |
| ***F04C 18/02*** | (2006.01) |

(52) U.S. Cl.
CPC ..... *F04C 18/0215* (2013.01); *F04C 23/008* (2013.01); *F04C 28/28* (2013.01); *F04C 29/02* (2013.01); *F04C 29/026* (2013.01); *F04B 39/023* (2013.01); *F04C 2240/81* (2013.01); *F04C 2270/24* (2013.01); *F04C 2270/86* (2013.01)

(58) Field of Classification Search
CPC .... F04C 29/026; F04C 18/0215; F04C 28/28; F04C 29/02; F04C 2240/81; F04C 2270/24; F04C 2270/86

See application file for complete search history.

(56) References Cited

U.S. PATENT DOCUMENTS

| | | | | |
|---|---|---|---|---|
| 2015/0064040 | A1* | 3/2015 | Brostrom ..... | F04C 29/04 418/84 |
| 2016/0187173 | A1* | 6/2016 | Jang ..... | F01M 11/12 137/2 |

FOREIGN PATENT DOCUMENTS

| | | | |
|---|---|---|---|
| JP | H07-098168 | A | 4/1995 |
| JP | 2002-317785 | A | 10/2002 |
| JP | 3511775 | B2 | 1/2004 |

OTHER PUBLICATIONS

Office Action dated May 7, 2019 issued in corresponding JP patent application No. 2017-564997 (and English translation).

* cited by examiner

COMPRESSOR, REFRIGERANT COMPRESSING APPARATUS, AND REFRIGERATING APPARATUS

CROSS REFERENCE TO RELATED APPLICATION

This application is a U.S. national stage application of International Application No. PCT/JP2016/053061, filed on Feb. 2, 2016, the contents of which are incorporated herein by reference.

TECHNICAL FIELD

The present invention relates to a refrigerant compressing apparatus and a refrigerating apparatus, and in particular to a compressor that compresses refrigerant, a refrigerant compressing apparatus including the compressor, and a refrigerating apparatus including the refrigerant compressing apparatus.

BACKGROUND

Conventional refrigerating apparatuses include a compressor such as the sealed scroll compressor described in Patent Literature 1.

In the scroll compressor, refrigerant gas sucked into the shell through a suction pipe is introduced into a compression mechanism composed of a fixed scroll and an orbiting scroll provided in an upper portion of the shell. When power is supplied to a sealed terminal to which, for example, a power line is connected, a torque is generated between a stator and a rotor constituting an electromotive mechanism located below the compression mechanism, and a spindle connected to the orbiting scroll is rotated.

Consequently, the orbiting scroll connected to the spindle is made to rotate and compresses, in collaboration with the fixed scroll, the refrigerant gas sucked into the compression mechanism. The compressed refrigerant gas is then discharged out of the shell through a discharge pipe.

In the scroll compressor, in addition, refrigerating machine oil stored in the bottom portion of the shell is sucked by a positive-displacement pump with the rotation of the spindle, and supplied to bearings and other peripheral components for lubrication through an oil passage inside the spindle. The refrigerating machine oil thus supplied flows down inside the shell, and is again stored in the bottom portion of the shell.

In the compressor as described above, when liquid refrigerant flows into the shell, and is mixed with the refrigerating machine oil stored in the bottom portion of the shell, a mixed liquid is produced, in which the oil concentration in the mixed liquid is lowered. In such a case, the lubrication characteristics for the bearings and the peripheral components may deteriorate.

Thus, to reduce the deterioration in lubrication characteristics, a method has been proposed in which a temperature sensor for measuring the temperature of the mixed liquid and a pressure sensor for measuring the pressure in the shell are provided in the compressor and the oil concentration is estimated on the basis of the temperature of the mixed liquid. When the estimated oil concentration exceeds a reference value, the operation of the compressor is controlled.

However, for the method of estimating the oil concentration, the temperature sensor and the pressure sensor have to be provided, thus complicating the configuration of the compressor.

In addition, the method only estimates an average value of the oil concentration in the mixed liquid located inside the shell. Consequently, for example, when the oil concentration becomes uneven, a proper control is unable to be executed.

For example, when the oil concentration is extremely low only in the vicinity of the inlet port of the oil pump, and higher in the remaining locations, the oil concentration becomes lower in the mixed liquid supplied to the bearings and other peripheral components. However, when the average value of the estimated oil concentration is within a normal range, the compressor is allowed to continuously operate, despite the oil concentration being low.

In addition, when the oil concentration sharply drops, for example, because of a high flow rate of liquid refrigerant flowing in through the suction pipe, a change in temperature of the mixed liquid can only be measured after a certain time has elapsed. Consequently, the drastic change in oil concentration is unable to be properly handled.

From another viewpoint, a liquid level of the refrigerating machine oil stored in the bottom portion of the shell of the conventional compressor is visually measured through a sight glass.

However, when the sight glass is mounted on the sealed casing, liquid tightness under a high pressure is required, and also an increased number of mounting steps have to be followed, thus making it difficult to mount the sight glass.

Further, when the sight glass is utilized, the liquid level of the refrigerating machine oil is measured by visual check, and consequently, the result may differ depending on the individual operator. Thus, it is difficult to accurately measure the liquid level.

In addition, the size of the sight glass defines the range of the level that can be visually checked, and consequently, when the liquid level of the refrigerating machine oil largely fluctuates, a large sight glass has to be provided corresponding to the fluctuation range.

To address these issues, techniques to provide an electrostatic capacitance sensor of various types in the bottom portion of the shell have been proposed.

For example, Patent Literature 2 describes a measuring device applicable to a compressor, the measuring device including an electrostatic capacitance-based oil sensor that includes a pair of parallel-plate electrodes located in the vicinity of the oil surface at an upper portion of the oil reservoir. The measuring device calculates the oil level in the oil reservoir and the oil concentration in the mixed liquid on the basis of the electrostatic capacitance measured by the electrostatic capacitance-based oil sensor, to control the operation of the compressor. Thus, the compressor can be protected from, for example, running out of the oil, and the resultant lack of lubrication for the bearings and other peripheral components.

Further, for example, Patent Literature 3 describes an oil measuring device applicable to a compressor, the oil measuring device including an electrostatic capacitance-based oil sensor constituted of a double cylindrical electrode formed in a flat shape and located in the vicinity of the inlet port of the oil pump. The oil measuring device is capable of measuring the oil concentration on the basis of factors including the presence of the oil surface and dissolution of the liquid refrigerant in the oil. In particular, even under a condition that allows the refrigerant to be sucked up through the oil pump due to bilayer separation of the oil that occurs when a CFC substitute refrigerant is used, the oil concentration can be measured.

PATENT LITERATURE

Patent Literature 1: Japanese Unexamined Patent Application Publication No. 5-209591

Patent Literature 2: Japanese Unexamined Patent Application Publication No. 7-98168

Patent Literature 3: Japanese Patent No. 3511775

With the measuring device according to Patent Literature 2, however, the oil level and the oil concentration are unable to be accurately measured, unless the oil level is at the position corresponding to the pair of parallel-plate electrodes, and the refrigerant and the refrigerating machine oil are uniformly mixed. Thus, mismeasurement is often provoked.

In particular, when a refrigerant immiscible with oil is employed, as a result of introduction of the CFC substitute refrigerant, the bilayer separation frequently occurs, thus further often provoking the mismeasurement.

In addition, in the measuring device, an electrode is added to a power supply terminal, and the electrode portion is cantilever-supported by a pin of the power supply terminal.

In such a case, a sufficient strength of the electrode has to be secured against the fluid force originating from the agitation of the oil and the flow of the refrigerant inside the compressor. For this purpose, it is necessary to reduce the area of the electrode portion subjected to the fluid force.

However, reducing the area of the electrode portion results in reduction of the electrostatic capacitance that can be measured, and consequently, the measuring accuracy is further degraded.

Further, with the oil measuring device according to Patent Literature 3, as the cylindrical electrode is formed in the flat shape, only a small electrostatic capacitance can be measured, and consequently, the measurement accuracy is insufficient.

To address such an issue, the diameter of the cylindrical electrode may be increased. However, the cylindrical electrode has to be located in a limited space, where the oil pump is provided inside the cylindrical electrode, and the shell is located on the outer side of the cylindrical electrode, and consequently, the cylinder diameter can only be increased to a limited extent. Thus, the improvement in measurement accuracy is desired.

SUMMARY

The present invention has been accomplished in view of the foregoing problems of the conventional techniques, and provides a compressor, a refrigerant compressing apparatus, and a refrigerating apparatus configured to improve the accuracy of measuring the oil concentration in the mixed liquid.

According to an embodiment of the present invention, a compressor includes a compressor including a compression mechanism configured to compress refrigerant, an electromotive mechanism configured to drive the compression mechanism, a shell accommodating the compression mechanism and the electromotive mechanism inside an inner surface of the shell in a radial direction, a reservoir provided inside the shell and configured to store mixed liquid including liquid refrigerant and refrigerating machine oil, and an electrode provided inside the reservoir and facing the inner surface of the shell.

The refrigerant compressing apparatus according to an embodiment of the present invention measures the specific dielectric constant of the mixed liquid on the basis of the electrostatic capacitance between the cylindrical electrode provided in the reservoir and the shell of the compressor, and thus improves the accuracy of measuring the oil concentration in the mixed liquid.

DETAILED DESCRIPTION

Embodiment 1

[Configuration of Compressor]

Hereinafter, a compressor according to Embodiment 1 of the present invention will be described.

Figure 1:
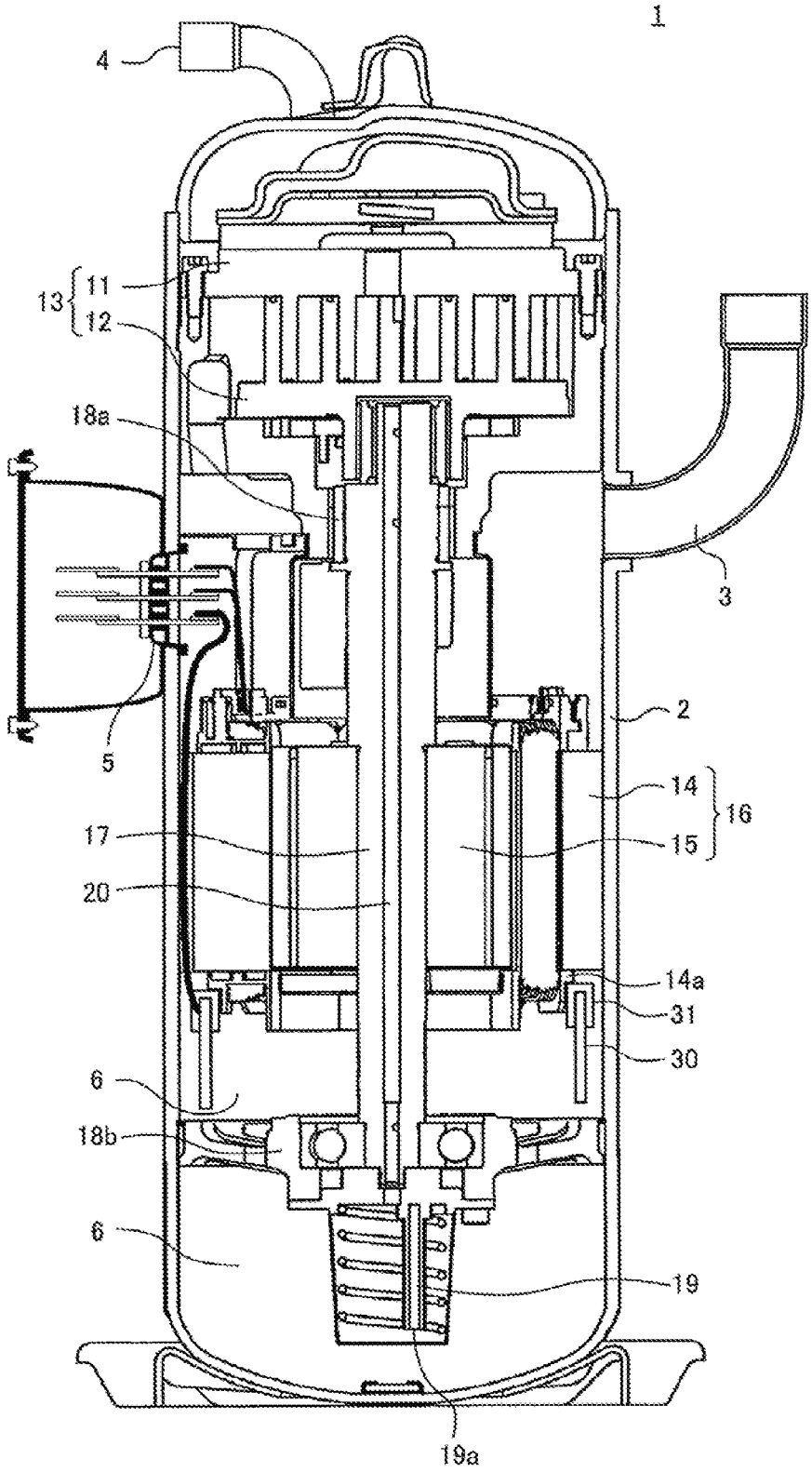
FIG. 1 is a front sectional view schematically illustrating a compressor according to Embodiment 1 of the present invention.

FIG. 1 is a schematic front sectional view illustrating a compressor 1 according to Embodiment 1 of the present invention. FIG. 1 illustrates an example where a scroll compressor is employed as the compressor 1.

As illustrated in FIG. 1, the compressor 1 includes a shell 2, which is a sealed container, a suction pipe 3 for sucking refrigerant gas, a discharge pipe 4 for discharging the compressed refrigerant gas, a sealed terminal 5, a reservoir 6, a compression mechanism 13 including a fixed scroll 11 and an orbiting scroll 12, an electromotive mechanism 16 including a stator 14 and a rotor 15, a spindle 17 including an oil passage 20 formed inside the spindle 17, a main bearing unit 18*a*, a sub bearing unit 18*b*, an oil pump 19, and a cylindrical electrode 30.

The shell 2 is formed of a conductive material such as a metal in a cylindrical shape. The shell 2 may be formed in a circular cylindrical shape having a circular cross-section in a view from above, or a square cylindrical shape having a rectangular cross-section.

The sealed terminal 5 is fixed to the shell 2 by a method that secures a sealing effect from outside, such as welding.

The sealed terminal 5 includes a plurality of terminals, to outside of the shell 2, for a power line to supply power to the stator 14 and a connection line of a thermal overload protector.

In addition, an electrode wire connected to the cylindrical electrode 30, which will be described later, is connected to the sealed terminal 5.

The reservoir 6 is provided in a bottom portion inside the shell 2, and is provided to store mixed liquid of liquid refrigerant mixed in the refrigerant gas introduced through the suction pipe 3 and at least refrigerating machine oil.

The compression mechanism 13 is located in an upper portion inside the shell 2, and compresses the refrigerant introduced through the suction pipe 3. The compression mechanism 13 includes the fixed scroll 11 and the orbiting scroll 12.

The fixed scroll 11 is fixed to a guide frame fixed to the shell 2, and includes a plate-shaped scroll lap formed on a lower face.

The orbiting scroll 12 is coupled with the spindle 17 to be described later, and includes a plate-shaped scroll lap formed on an upper face, the plate-shaped scroll lap having the same shape as the plate-shaped scroll lap of the fixed scroll 11.

The plate-shaped scroll lap of the fixed scroll 11 and the plate-shaped scroll lap of the orbiting scroll 12 are meshed with each other, and compression chambers each having a capacity relatively varying are defined between the scroll laps.

The electromotive mechanism 16 is located below the compression mechanism 13, and drives the compression mechanism 13. The electromotive mechanism 16 includes the stator 14 and the rotor 15.

The stator 14, on which a coil is wound, is located around the rotor 15.

The rotor 15 is located in the stator 14. In addition, the spindle 17 is coupled to the inside of the rotor 15.

When power is supplied to the stator 14 and a current flows through the coil wound on the stator 14, the rotor 15 located in the stator 14 is made to rotate. Consequently, the spindle 17 coupled with the rotor 15 is also made to rotate and transmits the driving force to the compression mechanism 13 connected to the spindle 17.

The spindle 17 has an upper end portion connected to the orbiting scroll 12, and a lower end portion connected to the rotor 15, and is driven by the electromotive mechanism 16 and to drive the orbiting scroll 12 to rotate.

The spindle 17 has an end supported by the main bearing unit 18*a*, and the other end supported by the sub bearing unit 18*b*.

The oil pump 19 is a positive-displacement pump located inside the reservoir 6.

The oil pump 19 sucks up the mixed liquid stored in the reservoir 6 through an inlet port 19*a* provided on a part close to the bottom portion of the shell 2, and supplies the mixed liquid to the compression mechanism 13, which includes sliding portions, through the oil passage 20 formed inside the spindle 17.

The oil pump 19 and the oil passage 20 constitute an oil supply unit.

The cylindrical electrode 30 is formed in a hollow cylindrical shape, and located above the sub bearing unit 18*b* in the reservoir 6 such that the outer circumferential surface of the cylindrical electrode 30 faces the inner surface of the shell 2. In addition, the electrode wire is connected to the cylindrical electrode 30 and the electrode wire is connected to the sealed terminal 5.

The cylindrical electrode 30 may be formed in a circular cylindrical shape having a circular cross-section in a view from above. Alternatively, as the cylindrical electrode 30 is fixed below the stator 14, the cylindrical electrode 30 may be formed in a shape having a polygonal cross-section that has the same number of apices as the number of poles of the stator 14, to facilitate the fixing of the cylindrical electrode 30, as will be described later in further detail.

Further, while the electrode is exemplified by the cylindrical electrode 30 in the description given below, an electrode of a different shape, for example, a shape having a C-shaped or a semicircular cross-section, or a plate-shaped electrode may be employed. For example, when the sealed terminal 5 is provided at the lower portion of the shell 2, it is preferable to employ an electrode having a cross section other than circular cross section, for example, having a C-shaped or a semicircular cross section to secure a sufficient insulation distance from the sealed terminal 5.

The cylindrical electrode 30 is provided to measure dielectric characteristics of the mixed liquid located between the electrode and the inner wall of the shell 2 facing the electrode.

To measure the dielectric characteristics of the mixed liquid, the cylindrical electrode 30 is mounted inside the shell 2 not to electrically contact with other conductive parts constituting the compressor 1. Further details of the mounting structure of the cylindrical electrode 30 will be described later.

In addition, the cylindrical electrode 30 utilizes the shell 2 as the outer electrode of the conventional double cylindrical electrode, for example, described in Patent Literature 3 referred to earlier. Such a configuration enables the cylindrical electrode 30 to have a larger diameter than ever. Further, the height of the cylindrical electrode 30 can also be increased.

[Configuration of Refrigerant Compressing Apparatus]

A refrigerant compressing apparatus including the compressor 1 will be described below.

Figure 2:
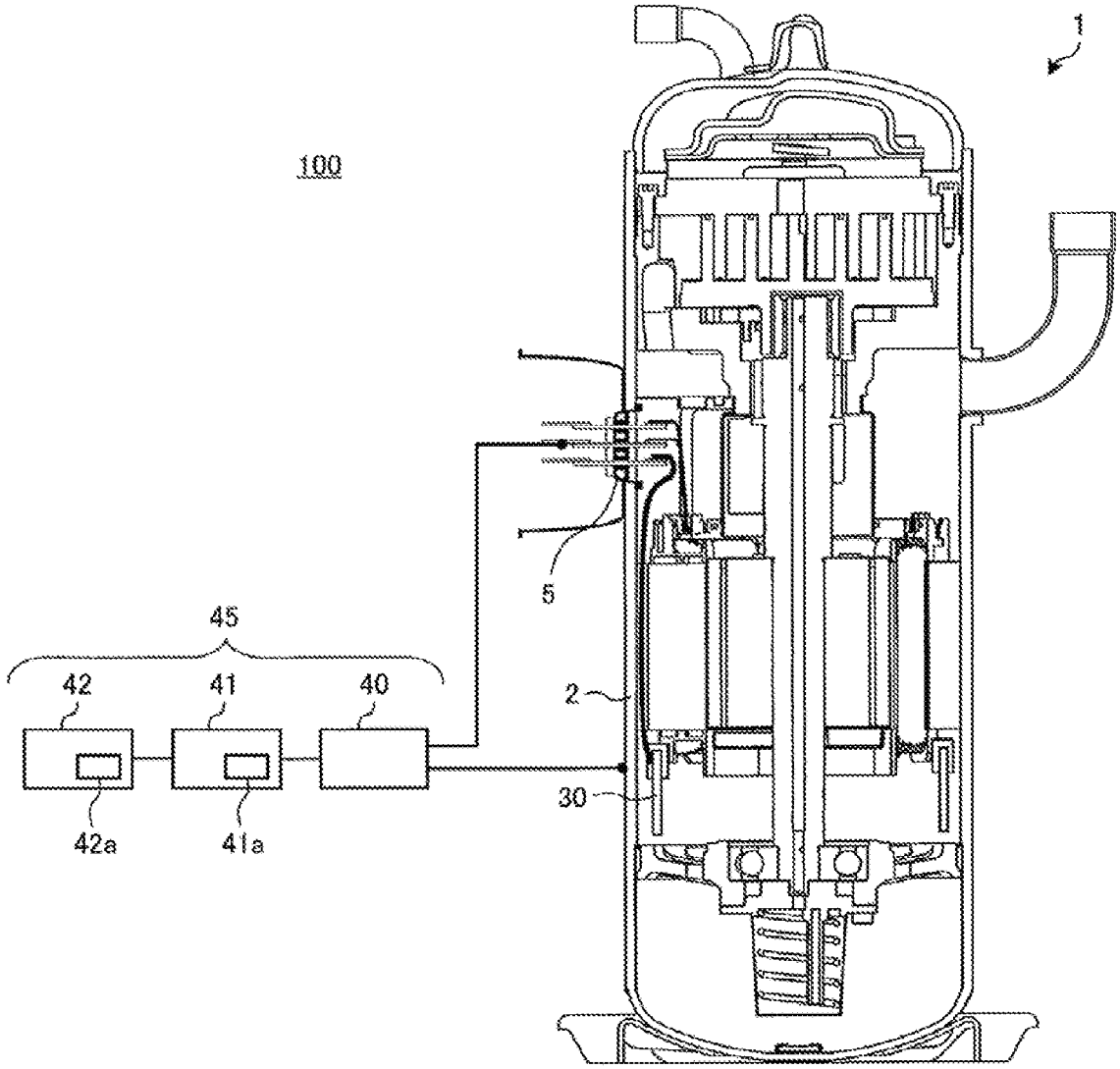
FIG. 2 is a block diagram illustrating an example of the configuration of a refrigerant compressing apparatus including the compressor illustrated in FIG. 1.

FIG. 2 is a block diagram illustrating an example of the configuration of the refrigerant compressing apparatus including the compressor illustrated in FIG. 1.

As illustrated in FIG. 2, a refrigerant compressing apparatus 100 includes the compressor 1 and a controller 45.

The controller 45 controls the operation of the compressor 1, as well as the refrigerant circuit as a whole to which the compressor 1 is connected. In addition, the controller 45 measures the oil concentration in the mixed liquid stored in the reservoir 6 of the compressor 1.

The controller 45 includes a specific dielectric constant measuring unit 40, an oil concentration measuring unit 41, and a control unit 42.

The specific dielectric constant measuring unit 40 is constituted of, for example, an LCR meter for measuring a parameter of electronic parts. The shell 2 and one of the plurality of terminals of the sealed terminal 5, to which the electrode wire from the cylindrical electrode 30 is connected, are connected to the specific dielectric constant measuring unit 40.

The specific dielectric constant measuring unit 40 measures the specific dielectric constant of the mixed liquid stored in the reservoir 6 on the basis of an electrostatic capacitance determined in advance from the distance between the shell 2 and the cylindrical electrode 30, and the surface area of the cylindrical electrode 30.

The specific dielectric constant measuring unit 40 is connected to the oil concentration measuring unit 41, to provide information indicating the measured specific dielectric constant, to the oil concentration measuring unit 41.

Specific examples of the specific dielectric constant measuring unit 40 include, without limitation to the LCR meter, hardware such as a circuit device that executes calculation of an electrostatic capacitance based on a voltage value and a current value, as well as calculation of a specific dielectric constant of the mixed liquid based on the electrostatic capacitance.

The oil concentration measuring unit 41 is connected to the specific dielectric constant measuring unit 40 and measures the oil concentration indicating the ratio of the refrigerating machine oil contained in the mixed liquid on the basis of the specific dielectric constant measured by the specific dielectric constant measuring unit 40.

The oil concentration measuring unit 41 is connected to the control unit 42 and sends information indicating the measured oil concentration to the control unit 42.

In addition, the oil concentration measuring unit 41 includes a memory 41*a* for storing the oil concentration information indicating the relation between the specific dielectric constant and the oil concentration in the mixed liquid.

Figure 3:
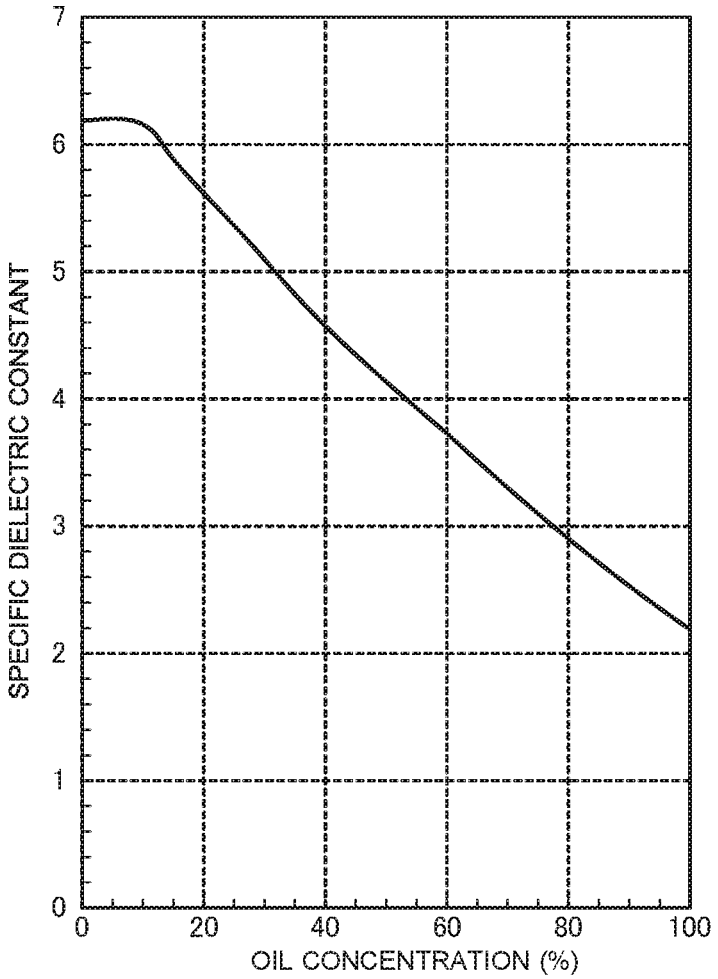
FIG. 3 is an illustration of an example of oil concentration information indicating a relation between a specific dielectric constant and the oil concentration.

FIG. 3 is an illustration of an example of the oil concentration information indicating the relation between the specific dielectric constant and the oil concentration.

The oil concentration information may be expressed as a table or as the graph illustrated in FIG. 3, in which the specific dielectric constant and the oil concentration are associated with each other. For example, when the oil concentration information is expressed as the graph illustrated in FIG. 3, the oil concentration corresponding to the specific dielectric constant measured by the specific dielectric constant measuring unit 40 can be obtained from the graph.

The relation between the specific dielectric constant and the oil concentration, which is represented by the oil concentration information, varies depending on the type of the refrigerant and the refrigerating machine oil employed. Thus, such relations have to be measured in advance through experiments, and stored in the memory 41*a*.

In addition, a leakage current is generated in the shell 2 during the operation of the compressor 1, and consequently, it is also preferable to store in the memory 41*a* information indicating noise originating from the leakage current. In this case, measuring the oil concentration in the mixed liquid by utilizing the information indicating the noise leads to improved accuracy of measuring the oil concentration.

The control unit 42 may be constituted of, for example, software executed on a computing device such as a microcomputer and a central processing unit (CPU), or hardware such as a circuit device for executing an oil concentration measurement process to be described later.

The control unit 42 controls the compressor 1 corresponding to the oil concentration in the mixed liquid on the basis of the information indicating the oil concentration received from the oil concentration measuring unit 41.

In addition, the control unit 42 includes a memory 42*a* for storing a first concentration and a second concentration, which are predetermined thresholds of the oil concentration in the mixed liquid.

The first concentration corresponds to an extremely low oil concentration in the mixed liquid, at which the control unit 42 determines that it is difficult to sufficiently lubricate the sliding portions, and that the compressor 1 may be damaged. As a specific example, the first concentration may be set to 20%.

The second concentration corresponds to a low oil concentration in the mixed liquid, at which the control unit 42 determines that it is difficult to sufficiently lubricate the sliding portions, and is set to a value higher than the first concentration. As a specific example, the second concentration may be set to 50%.

The values of the first and second concentrations may be set as desired, without limitation to the foregoing examples and may be set in accordance with the specification of the compressor 1 to be actually utilized, the properties of the refrigerating machine oil and the refrigerant, and other factors.

The control unit 42 compares the oil concentration indicated by the information received from the oil concentration measuring unit 41 and the first and second concentrations, and controls, corresponding to the comparison result, the components in the refrigerant compressing apparatus 100 or in the circuit in which the refrigerant compressing apparatus 100 is incorporated.

More specifically, when the oil concentration in the mixed liquid is, for example, equal to or lower than the first concentration, the control unit 42 stops the operation of the compressor 1. When the oil concentration is equal to or lower than the second concentration, the control unit 42 performs a control to reduce the flow rate of the liquid refrigerant returning to the compressor 1, in other words the liquid-back amount.

Further, the control unit 42 measures the liquid level of the mixed liquid, on the basis of the oil concentration indicated by the information received from the oil concentration measuring unit 41.

Here, part of the refrigerant gas introduced through the suction pipe 3 flows into the bottom portion in the shell 2. At this point, in the case where the liquid level of the mixed liquid stored in the reservoir 6 is below the cylindrical electrode 30, in other words when the liquid level of the mixed liquid is below the lower end of the cylindrical electrode 30, the refrigerant gas that has flowed in is located between the cylindrical electrode 30 and the shell 2. Thus, the specific dielectric constant measuring unit 40 measures the specific dielectric constant of the refrigerant gas, instead of that of the mixed liquid.

In contrast, in the case where the liquid level of the mixed liquid has reached the cylindrical electrode 30, in other words when the liquid level of the mixed liquid is at a level equal to or higher than the lower end of the cylindrical electrode 30, the mixed liquid is located between the cylindrical electrode 30 and the shell 2. Thus, the specific dielectric constant measuring unit 40 measures the specific dielectric constant of the mixed liquid.

The mixed liquid, which is a liquid, and the refrigerant gas, which is a gas, typically have a large difference in specific dielectric constant, from each other. Thus, the value of the oil concentration in the mixed liquid, measured on the basis of the specific dielectric constant, also largely differs.

Consequently, measuring the oil concentration in the mixed liquid or in the refrigerant gas located between the cylindrical electrode 30 and the shell 2 enables, in addition to the oil concentration in the mixed liquid, whether the mixed liquid is located between the cylindrical electrode 30 and the shell 2 to be determined. Consequently, the control unit 42 can measure the liquid level of the mixed liquid.

More specifically, for example, the control unit 42 determines, on the basis of the oil concentration, that the liquid level of the mixed liquid in the reservoir 6 is at least lower than the lower end of the cylindrical electrode 30 when the control unit 42 determines that the mixed liquid is not located between the cylindrical electrode 30 and the shell 2. In contrast, when the control unit 42 determines that the mixed liquid is located between the cylindrical electrode 30 and the shell 2, the control unit 42 determines that the liquid level of the mixed liquid is at a level at least equal to or higher than the lower end of the cylindrical electrode 30.

[Mounting Structure of Cylindrical Electrode]

FIRST MOUNTING EXAMPLE

The mounting structure of the cylindrical electrode 30 in the shell 2 will be described below.

FIG. 1 illustrates a first mounting example of the cylindrical electrode 30. In the first mounting example as illustrated in FIG. 1, one or a plurality of electrode supporters 31 formed of a non-conductive material, for example, made of a resin are attached to a stator insulating unit 14*a* provided on the lower portion of the stator 14 and formed of a similar non-conductive material. Then, the upper end portion of the cylindrical electrode 30 is held by the electrode supporter 31, and thus the cylindrical electrode 30 is supported and fixed. Thus, the cylindrical electrode 30 can be mounted inside the shell 2.

Here, without limitation to the first mounting example, the stator insulating unit 14*a* may be formed in advance, for example, in a shape that can support the cylindrical electrode 30, and the stator insulating unit 14*a* and the electrode supporter 31 are integrally formed.

SECOND MOUNTING EXAMPLE

Figure 4:
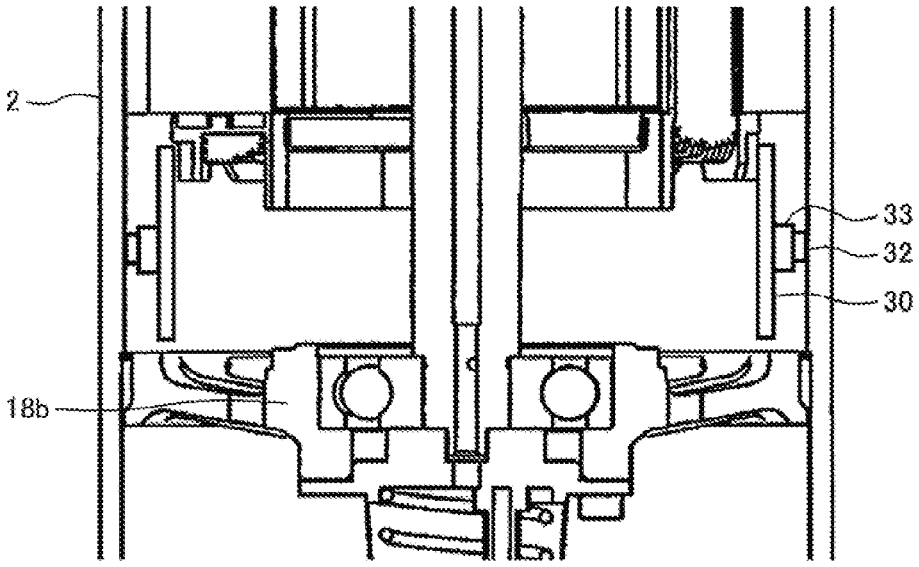
FIG. 4 is a schematic view illustrating a second mounting example of a cylindrical electrode in the compressor illustrated in FIG. 1.

FIG. 4 is a schematic view illustrating a second mounting example of the cylindrical electrode 30 in the compressor 1 illustrated in FIG. 1.

In the second mounting example as illustrated in FIG. 4, one or a plurality of pedestals 32 for mounting the cylindrical electrode 30 in the shell 2 are fixed to the inner wall of the shell 2. Then, the cylindrical electrode 30 is attached to the pedestal 32 such that a non-conductive unit 33 is provided between the cylindrical electrode 30 and the pedestal 32, for example, made of a resin. The cylindrical electrode 30 can thus be mounted inside the shell 2.

THIRD MOUNTING EXAMPLE

Figure 5:
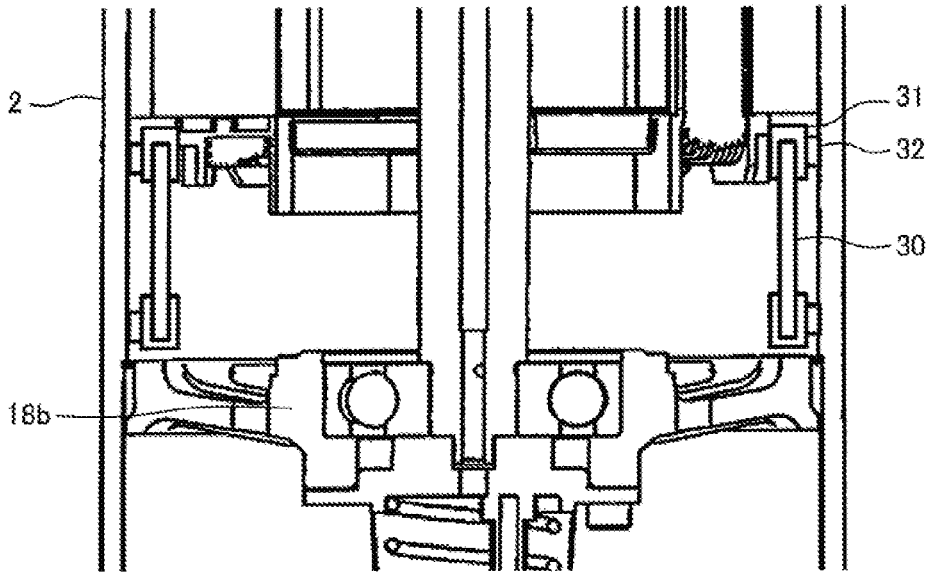
FIG. 5 is a schematic view illustrating a third mounting example of the cylindrical electrode in the compressor illustrated in FIG. 1.

FIG. 5 is a schematic view illustrating a third mounting example of the cylindrical electrode 30 in the compressor 1 illustrated in FIG. 1.

In the third mounting example as illustrated in FIG. 5, one or a plurality of the electrode supporters 31 are attached to the cylindrical electrode 30 such that the upper and lower end portions of the cylindrical electrode 30 are held. In addition, one or a plurality of pedestals 32 of which number corresponds to the number of the electrode supporters 31 are fixed to the inner wall of the shell 2. Then, the electrode supporters 31 supporting the cylindrical electrode 30 are fixed to the pedestals 32. The cylindrical electrode 30 can thus be mounted inside the shell 2.

FOURTH MOUNTING EXAMPLE

Figure 6:
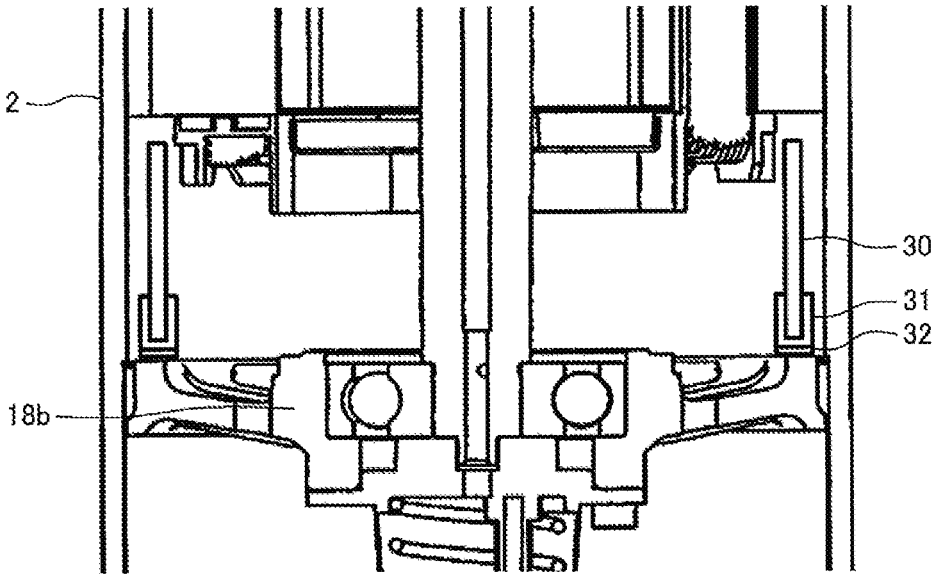
FIG. 6 is a schematic view illustrating a fourth mounting example of the cylindrical electrode in the compressor illustrated in FIG. 1.

FIG. 6 is a schematic view illustrating a fourth mounting example of the cylindrical electrode 30 in the compressor 1 illustrated in FIG. 1.

In the fourth mounting example as illustrated in FIG. 6, one or a plurality of the electrode supporters 31 are attached to the cylindrical electrode 30 such that the lower end portion of the cylindrical electrode 30 is held. In addition, one or a plurality of pedestals 32 of which number corresponds to the number of the electrode supporters 31 are fixed to the sub bearing unit 18*b*, and the electrode supporters 31 are fixed to the pedestals 32. The cylindrical electrode 30 can thus be mounted inside the shell 2.

Mounting the cylindrical electrode 30 inside the shell 2 as described in the first to the fourth mounting examples prevents the cylindrical electrode 30 from contacting with the conductive parts provided in the shell 2.

Here, the electrode supporter 31 and the pedestal 32 may be formed, for example, to continuously extend all over the circumference of the cylindrical electrode 30. Alternatively, for example, the electrode supporters 31 and the pedestals 32 may each be formed to have a certain length along the circumference of the cylindrical electrode 30, and circumferentially aligned at predetermined intervals.

Further, the method of mounting the cylindrical electrode 30 is not limited to the first to the fourth mounting examples and, for example, two or more of these mounting examples may be adopted in combination. In such a case, however, the workability and the cost in assembling the compressor 1 and other factors have to be taken into account.

[Example of Circuit to Which Compressor is Applicable]

A circuit to which the refrigerant compressing apparatus 100 including the compressor 1 is applicable will be described below.

Figure 7:
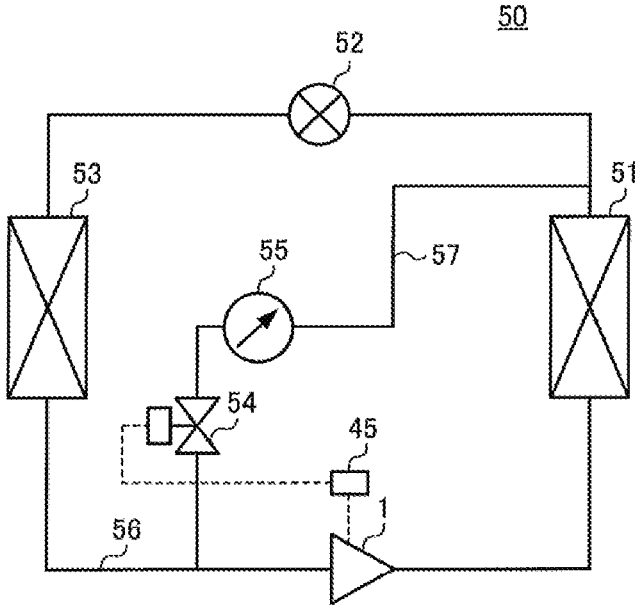
FIG. 7 is a schematic diagram illustrating an example of a refrigerating apparatus, to which the refrigerant compressing apparatus illustrated in FIG. 2 is applicable.

FIG. 7 is a schematic diagram illustrating an example of the refrigerating apparatus to which the refrigerant compressing apparatus 100 illustrated in FIG. 2 is applicable.

As illustrated in FIG. 7, a refrigerating apparatus 50 includes the compressor 1 installed in the refrigerant compressing apparatus 100 that compresses the refrigerant, a heat source-side heat exchanger 51 that exchanges heat between the refrigerant and an external fluid, an expansion valve 52 that depressurizes and expands the refrigerant, a use-side heat exchanger 53 that exchanges heat between the refrigerant and an external fluid, an expansion device 54 that controls the flow rate of the refrigerant, a flowmeter 55 that measures the flow rate of the refrigerant, and the controller 45 that controls the operation of the compressor 1 and the opening degree of the expansion device 54.

In addition, the compressor 1, the heat source-side heat exchanger 51, the expansion valve 52, and the use-side heat exchanger 53 are sequentially connected via a refrigerant pipe 56, to thereby constitute a refrigerant circuit in which the refrigerant circulates through the refrigerant pipe 56.

Further, a bypass pipe 57 is connected to the refrigerant pipe 56 at a position between the heat source-side heat exchanger 51 and the expansion valve 52 and is connected to the refrigerant pipe 56 at a position between the use-side heat exchanger 53 and the compressor 1, and the expansion device 54 and the flowmeter 55 are connected to the bypass pipe 57, thus to constitute a bypass circuit.

The bypass circuit is provided to adjust the flow rate of the refrigerant flowing into the compressor 1, and is utilized, for example, by the control unit 42 to reduce the liquid-back amount to the compressor 1.

In the refrigerating apparatus 50, first, low-temperature and low-pressure refrigerant is compressed by the compressor 1 to turn into high-temperature and high-pressure gas refrigerant, and discharged from the compressor 1.

The high-temperature and high-pressure gas refrigerant discharged from the compressor 1 flows into the heat source-side heat exchanger 51 acting as condenser, to be condensed while rejecting heat through heat exchange with an external fluid such as air and water, and flows out from the heat source-side heat exchanger 51 in a form of subcooled high-pressure liquid refrigerant.

The high-pressure liquid refrigerant that has flowed out from the heat source-side heat exchanger 51 is depressurized and expanded by the expansion valve 52 thus to turn into low-temperature and low-pressure two-phase gas-liquid refrigerant, and flows into the use-side heat exchanger 53 acting as evaporator.

The low-temperature and low-pressure two-phase gas-liquid refrigerant that has flowed into the use-side heat exchanger 53 receives heat and is evaporated through heat exchange with the room air, thereby cooling the room air, and flows out from the use-side heat exchanger 53 in the form of low-temperature and low-pressure gas refrigerant.

The low-temperature and low-pressure gas refrigerant that has flowed out from the use-side heat exchanger 53 is sucked into the compressor 1.

At this time, in the case where the oil concentration in the mixed liquid stored in the reservoir 6 in the compressor 1 is lower than a predetermined concentration, the control unit 42 reduces the liquid-back amount to the compressor 1.

In this case, the control unit 42 controls the flow rate of the refrigerant flowing through the bypass circuit by adjusting the opening degree of the expansion device 54 on the basis of the flow rate of the refrigerant measured by the flowmeter 55. Increasing the opening degree of the expansion device 54 increases the flow rate of the refrigerant flowing into the compressor 1, and reducing the opening degree of the expansion device 54 reduces the flow rate of the refrigerant flowing into the compressor 1.

Further, to reduce the liquid-back amount to the compressor 1, the control unit 42 may, for example, control the flow rate of the refrigerant flowing into the use-side heat exchanger 53 by adjusting the opening degree of the expansion valve 52, and sufficiently gasify the refrigerant in the use-side heat exchanger 53. The control unit 42 may thus restrict the liquid refrigerant flowing into the compressor 1.

As described above, the absolute amount of the liquid refrigerant contained in the refrigerant flowing into the compressor 1 can be reduced, by adjusting the flow rate of the refrigerant flowing into the compressor 1, to reduce the flow rate compared with that of the normal operation. Consequently, the amount of the liquid refrigerant in the mixed liquid can be reduced, thus to increase the oil concentration.

The foregoing example of the refrigerating apparatus 50 corresponds to the circuit for performing a cooling operation. However, a heating operation can also be performed, for example, by changing the connection positions of the heat source-side heat exchanger 51 and the use-side heat exchanger 53. Also, in the circuit for performing the heating operation, the liquid-back amount to the compressor 1 can be reduced, thus to increase the oil concentration.

[Operation of Compressor]

The operation of the compressor 1 according to Embodiment 1 will be described below.

First, when the refrigerant gas is sucked into the shell 2 of the compressor 1 through the suction pipe 3, the refrigerant gas sucked into the shell 2 is introduced into the compression mechanism 13 composed of the fixed scroll 11 and the orbiting scroll 12.

Then, when power is supplied to the sealed terminal 5, a torque is generated between the stator 14 and the rotor 15 constituting the electromotive mechanism 16, and thus the spindle 17 is rotated.

Thus, the orbiting scroll 12 connected to the spindle 17 is made to rotate, and compresses the refrigerant gas sucked into the compression mechanism 13 in collaboration with the fixed scroll 11. The compressed refrigerant gas is then discharged out of the shell 2 through the discharge pipe 4.

In addition, the mixed liquid stored in the bottom portion of the shell 2 is sucked by the oil pump 19 with the rotation of the spindle 17, and supplied to the sliding portions such as the main bearing unit 18*a* and the sub bearing unit 18*b* for lubrication, through the oil passage 20.

The mixed liquid thus supplied flows down inside the shell, and is again stored in the reservoir 6.

[Oil Concentration Measurement]

Description will be given below regarding the flow of the oil concentration measurement process, performed by the refrigerant compressing apparatus 100.

Figure 8:
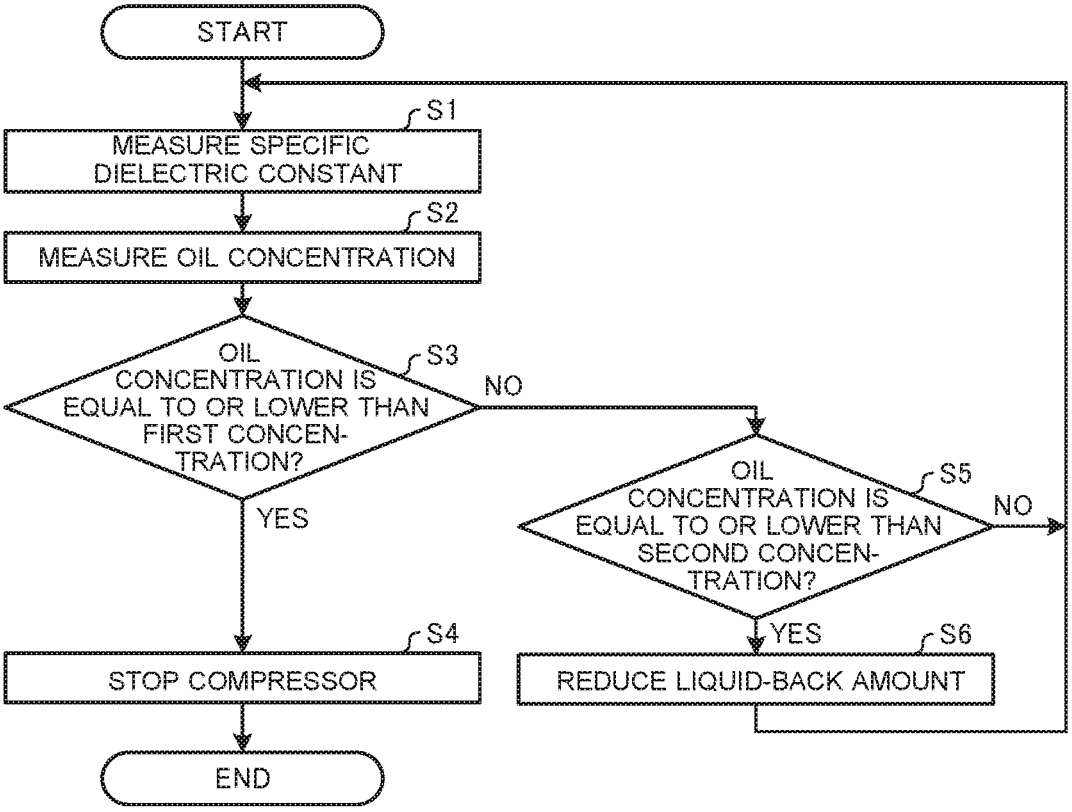
FIG. 8 is a flowchart illustrating an example of oil concentration measurement process, performed by the refrigerant compressing apparatus illustrated in FIG. 2.

FIG. 8 is a flowchart illustrating an example of the oil concentration measurement process performed by the refrigerant compressing apparatus 100 illustrated in FIG. 2.

First, at step S1, the specific dielectric constant measuring unit 40 measures the specific dielectric constant of the mixed liquid stored in the reservoir 6 on the basis of the electrostatic capacitance between the shell 2 and the cylindrical electrode 30. Then, the specific dielectric constant measuring unit 40 sends information indicating the measured specific dielectric constant to the oil concentration measuring unit 41.

At step S2, the oil concentration measuring unit 41 measures the oil concentration in the mixed liquid when the oil concentration measuring unit 41 receives the information indicating the measured specific dielectric constant from the specific dielectric constant measuring unit 40, by looking up the oil concentration information stored in the memory 41*a* on the basis of the specific dielectric constant indicated by the received information. The oil concentration measuring unit 41 then sends information indicating the measured oil concentration to the control unit 42.

At step S3, when the control unit 42 receives the information indicating the measured oil concentration from the oil concentration measuring unit 41, the control unit 42 compares the oil concentration indicated by the received information and the first concentration stored in the memory 42*a*.

When the control unit 42 determines that the oil concentration is equal to or lower than the first concentration as a result of the comparison (YES at step S3), the control unit 42 stops the operation of the compressor 1, at step S4. To stop the operation of the compressor 1, control unit 42 disconnects the electromotive mechanism 16 from the power line connected to the sealed terminal 5, thus cutting off the power supply to the electromotive mechanism 16.

In contrast, when the control unit 42 determines that the oil concentration is higher than the first concentration (NO at step S3), the process advances to step S5, where the control unit 42 compares the oil concentration and the second concentration stored in the memory 42*a*.

When the control unit 42 determines that the oil concentration is equal to or lower than the second concentration as a result of the comparison (YES at step S5), the control unit 42 reduces the liquid-back amount to the compressor 1, at step S6. To reduce the liquid-back amount, for example, the control unit 42 controls the opening degree of the expansion device 54 illustrated in FIG. 7 and thus adjusts the flow rate of the refrigerant flowing into the compressor 1.

In contrast, when the control unit 42 determines that the oil concentration is higher than the second concentration (NO at step S5), the process returns to step S1, from where the series of the process from step S1 to step S6 are cyclically repeated, at predetermined time intervals.

As described above, in Embodiment 1, the oil concentration in the mixed liquid stored in the compressor 1 is measured utilizing the specific dielectric constant based on the electrostatic capacitance between the cylindrical electrode 30 and the shell 2. Consequently, the oil concentration in the mixed liquid can be measured with a simple configuration.

In addition, the configuration according to Embodiment 1 not only enables the measurement of the oil concentration in the mixed liquid, but also the determination of whether the mixed liquid is located between the cylindrical electrode 30 and the shell 2, and consequently, the liquid level of the mixed liquid can also be measured.

In Embodiment 1, further, the cylindrical electrode 30 used for measuring the specific dielectric constant of the mixed liquid is larger in diameter and height, than the conventional electrodes. Such a configuration contributes to improving the accuracy of measuring the oil concentration, as well as the liquid level of the mixed liquid.

Still further, in Embodiment 1, the oil concentration is periodically measured at predetermined time intervals, and the operation of the compressor 1 or the refrigerant compressing apparatus 100 is controlled corresponding to the oil concentration that is measured. Such a configuration promptly follows fluctuations of the oil concentration, thereby preventing damage to the compressor 1 originating from insufficient lubrication.

Embodiment 2

A compressor according to Embodiment 2 of the present invention will be described below.

In Embodiment 2, the cylindrical electrode 30 is located at the height corresponding to the height of the oil pump 19, to surround the oil pump 19, to further improve the accuracy of measuring the oil concentration in the mixed liquid located at the position that allows the oil pump 19 to suck up the mixed liquid.

[Configuration of Compressor]

Figure 9:
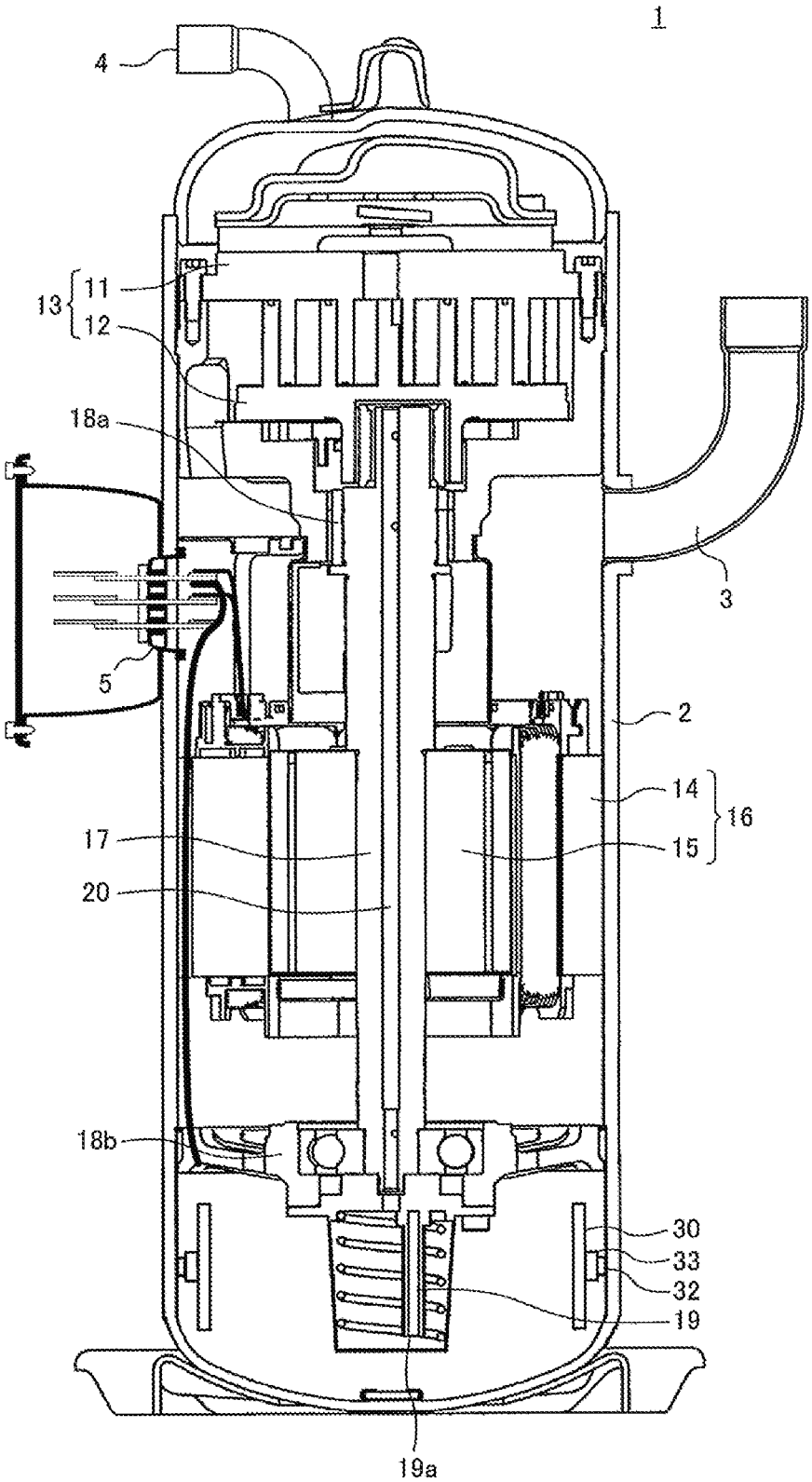
FIG. 9 is a schematic front sectional view illustrating a compressor according to Embodiment 2 of the present invention.

FIG. 9 is a schematic front sectional view illustrating the compressor 1 according to Embodiment 2 of the present invention. FIG. 9 illustrates, as in Embodiment 1, an example where the scroll compressor is employed as the compressor 1. The same components as those of the compressor 1 of Embodiment 1 will be given the same reference sign, and the detailed description of the components will be omitted.

The compressor 1 according to Embodiment 2 is different from the compressor of Embodiment 1 only in the position where the cylindrical electrode 30 is located. As illustrated in FIG. 9, the cylindrical electrode 30 is located at the height corresponding to the height of the oil pump 19 in the reservoir 6, to surround the oil pump 19.

Thus, the oil concentration measuring unit 41 can measure the oil concentration in the mixed liquid having the same oil concentration as the mixed liquid actually sucked up by the oil pump 19.

[Mounting Structure of Cylindrical Electrode]

FIFTH MOUNTING EXAMPLE

The mounting structure of the cylindrical electrode 30 in the shell 2 will be described below.

FIG. 9 illustrates a fifth mounting example of the cylindrical electrode 30. In the fifth mounting example, as illustrated in FIG. 9, one or a plurality of pedestals 32 are fixed to the inner wall of the shell 2. Then, the cylindrical electrode 30 is attached to the pedestal 32 such that the non-conductive unit 33 is between the cylindrical electrode 30 and the pedestal 32. The cylindrical electrode 30 can thus be mounted inside the shell 2.

SIXTH MOUNTING EXAMPLE

Figure 10:
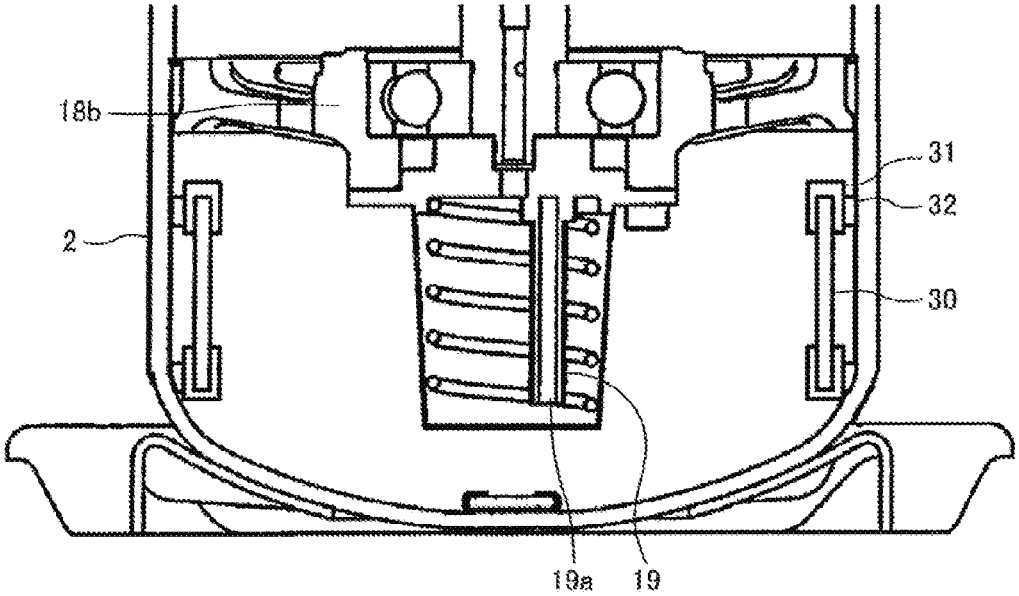
FIG. 10 is a schematic view illustrating a sixth mounting example of a cylindrical electrode in the compressor illustrated in FIG. 9.

FIG. 10 is a schematic view illustrating a sixth mounting example of a cylindrical electrode 30 in the compressor 1 illustrated in FIG. 9.

In the sixth mounting example, as illustrated in FIG. 10, one or a plurality of the electrode supporters 31 are attached to the cylindrical electrode 30, to hold the upper and lower end portions of the cylindrical electrode 30. In addition, one or a plurality of pedestals 32 of which number corresponds to the number of the electrode supporters 31 are fixed to the inner wall of the shell 2. Then, the electrode supporters 31 supporting the cylindrical electrode 30 are fixed to the pedestals 32. The cylindrical electrode 30 can thus be mounted inside the shell 2.

SEVENTH MOUNTING EXAMPLE

Figure 11:
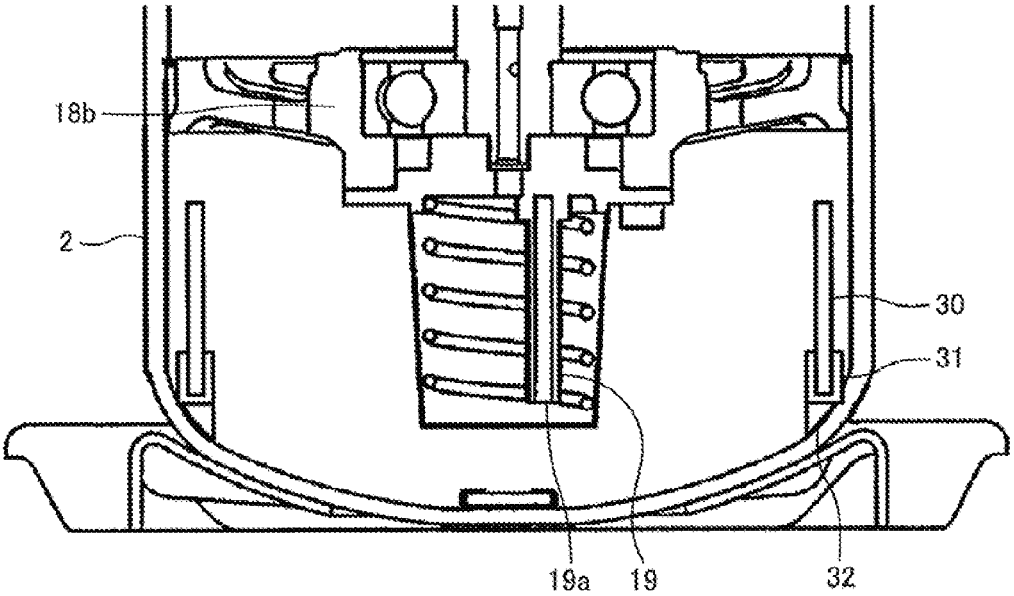
FIG. 11 is a schematic view illustrating a seventh mounting example of the cylindrical electrode in the compressor illustrated in FIG. 9.

FIG. 11 is a schematic view illustrating a seventh mounting example of the cylindrical electrode 30 in the compressor 1 illustrated in FIG. 9.

In the seventh mounting example, as illustrated in FIG. 11, one or a plurality of the electrode supporters 31 are attached to the cylindrical electrode 30, to hold the lower end portion of the cylindrical electrode 30. In addition, one or a plurality of pedestals 32 of which number corresponds to the number of the electrode supporters 31 are fixed to the bottom portion of the shell 2, and the electrode supporters 31 are fixed to the pedestals 32. The cylindrical electrode 30 can thus be mounted inside the shell 2.

EIGHTH MOUNTING EXAMPLE

Figure 12:
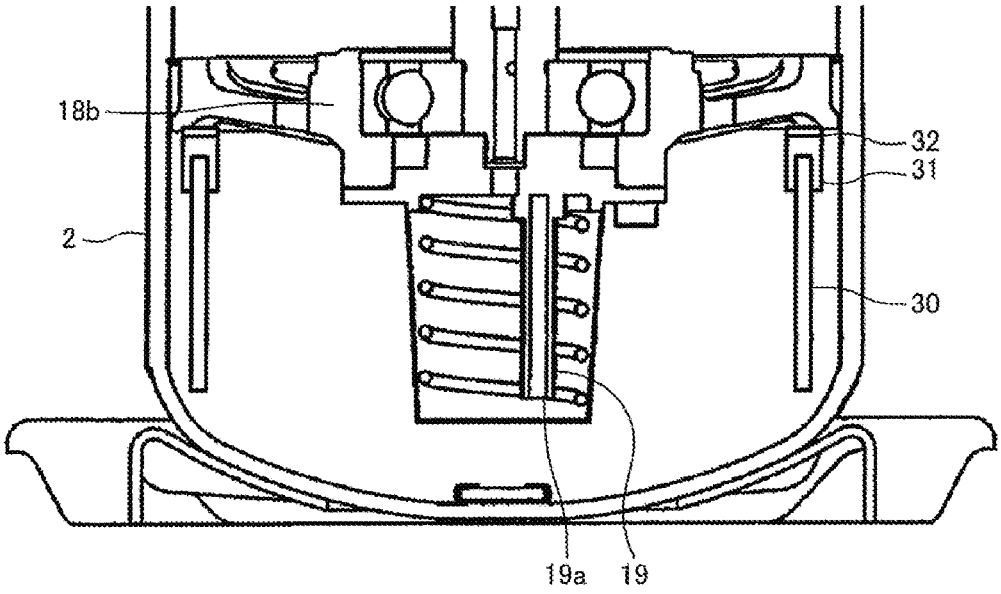
FIG. 12 is a schematic view illustrating an eighth mounting example of the cylindrical electrode in the compressor illustrated in FIG. 9.

FIG. 12 is a schematic view illustrating an eighth mounting example of the cylindrical electrode 30 in the compressor illustrated in FIG. 9.

In the eighth mounting example, as illustrated in FIG. 12, one or a plurality of the electrode supporters 31 are attached to the cylindrical electrode 30, to hold the upper end portion of the cylindrical electrode 30. In addition, one or a plurality of pedestals 32 of which number corresponds to the number of the electrode supporters 31 are fixed to the lower portion of the sub bearing unit 18*b*, and the electrode supporters 31 are fixed to the pedestals 32. The cylindrical electrode 30 can thus be mounted inside the shell 2.

Mounting thus the cylindrical electrode 30 inside the shell 2 as in the fifth to the eighth mounting examples surely prevents the cylindrical electrode 30 from with the conductive parts provided in the shell 2, as in Embodiment 1.

Here, the electrode supporter 31 and the pedestal 32 may be formed, for example, to continuously extend all over the circumference of the cylindrical electrode 30, as in Embodiment 1. Alternatively, for example, the electrode supporters 31 and the pedestals 32 may each be formed to have a certain length along the circumference of the cylindrical electrode 30, and circumferentially aligned at predetermined intervals.

Further, the method of mounting the cylindrical electrode 30 is not limited to the fifth to the eighth mounting examples and, for example, two or more of these mounting examples may be adopted in combination. In such a case, however, the workability and the cost in assembling the compressor 1 and other factors have to be taken into account.

In Embodiment 2, as described above, the cylindrical electrode 30 is located at the height corresponding to the height of the oil pump 19, to surround the oil pump 19. Thus, in terms of the oil concentration, the mixed liquid located between the cylindrical electrode 30 and the shell 2 is the same as the mixed liquid actually sucked up by the oil pump 19. Thus, the oil concentration measuring unit 41 measures the oil concentration in the mixed liquid that is sucked up by the oil pump 19, and consequently, the accuracy of measuring the oil concentration in the mixed liquid can be further improved.

Even when, for example, the refrigerating machine oil and the liquid refrigerant are separated from each other into two layers, because of the mixed liquid remaining still while the compressor 1 is not in operation, the oil concentration in either of the refrigerating machine oil and the liquid refrigerant sucked up by the oil pump 19, out of the two liquids separated from each other, can be measured.

The liquid refrigerant and the refrigerating machine oil typically have a large difference in specific dielectric constant, from each other. Consequently, the control unit 42 can determine whether the mixed liquid located around the oil pump is the refrigerating machine oil or the liquid refrigerant separated from each other on the basis of the oil concentration obtained from the specific dielectric constant of the mixed liquid.

More specifically, for example, when the liquid refrigerant is lower in density than the refrigerating machine oil, the refrigerating machine oil resides in the lower layer of the mixed liquid, and the liquid refrigerant resides in the upper layer.

In the case where the specific dielectric constant of the mixed liquid measured by the specific dielectric constant measuring unit 40 indicates a value corresponding to a liquid predominantly containing the refrigerating machine oil, when the mixed liquid is separated as above, the oil concentration measured by the oil concentration measuring unit 41 becomes 100%, or a percentage close to 100%. Thus, the control unit 42 can determine that the mixed liquid located around the oil pump 19 is the refrigerating machine oil separated from the liquid refrigerant. As sucking up the refrigerating machine oil with the oil pump 19 is harmless, the operation of the compressor 1 can be started.

In contrast, when the specific dielectric constant of the mixed liquid measured by the specific dielectric constant measuring unit 40 indicates a value corresponding to a liquid predominantly containing the liquid refrigerant, the oil concentration measured by the oil concentration measuring unit 41 becomes 0%, or a percentage close to 0%. Thus, the control unit 42 can determine that the mixed liquid located around the oil pump 19 is the liquid refrigerant separated from the refrigerating machine oil. Consequently, the compressor 1 is kept from being operated, because sucking up the liquid refrigerant with the oil pump 19 disables the sliding portions from being lubricated.

Further, when the liquid refrigerant is higher in density than the refrigerating machine oil, the liquid refrigerant oil resides in the lower layer, and the refrigerating machine oil resides in the upper layer.

In the case where the specific dielectric constant of the mixed liquid measured by the specific dielectric constant measuring unit 40 indicates a value corresponding to a liquid predominantly containing the liquid refrigerant, when the mixed liquid is separated as above, the oil concentration measured by the oil concentration measuring unit 41 becomes 0%, or a percentage close to 0%. Thus, the control unit 42 determines that the mixed liquid located around the oil pump 19 is the liquid refrigerant separated from the refrigerating machine oil. Consequently, the compressor 1 is kept from being operated, because sucking up the liquid refrigerant with the oil pump 19 disables the sliding portions from being lubricated.

In case that the liquid refrigerant has been sucked up by the oil pump 19, and consequently, the compressor 1 is unable to be operated, it is preferable to heat the liquid refrigerant, for example, with a belt heater or by restrained energization, and start the operation of the compressor 1 after the refrigerant is gasified.

To further improve the accuracy of measuring the specific dielectric constant and the oil concentration of the liquid actually sucked up by the oil pump 19, it is preferable to locate the lower end of the cylindrical electrode 30 and the inlet port 19*a* of the oil pump 19 at the same height.

Further, as the cylindrical electrode 30 is located at the same height as the oil pump 19 in Embodiment 2, the liquid level against the oil pump 19 can be measured. Thus, even when the liquid level of the mixed liquid is lower than the inlet port 19*a* of the oil pump 19, or even when the mixed liquid has run out, a prompt and efficient control can be executed to prevent damage to the compressor 1 originating from insufficient lubrication.

Embodiment 3

A compressor according to Embodiment 3 of the present invention will be described below.

The typical oil concentration in the mixed liquid stored in the reservoir 6 in the shell 2 is not uniformly distributed, but is often unevenly distributed. In addition, as the oil concentration measured by the oil concentration measuring unit 41 is the average value of the oil concentration in the mixed liquid located between the cylindrical electrode 30 and the shell 2, the measured oil concentration may be different from the oil concentration in the mixed liquid actually sucked up by the oil pump 19.

Thus, even when the measured oil concentration has led to the determination that the sliding portions can be sufficiently lubricated, the oil concentration in the mixed liquid actually sucked up by the oil pump 19 may be lower than the measured oil concentration.

In such a case, the sliding portions of the compressor 1 may be damaged with the low oil concentration in the mixed liquid.

Conversely, even when the measured oil concentration has led to the determination that it is difficult to properly lubricate the sliding portions, the oil concentration in the mixed liquid actually sucked up by the oil pump 19 may be higher than the measured oil concentration, to the extent that the sliding portions can be sufficiently lubricated.

In such a case, it is harmless to keep the compressor 1 in normal operation, and consequently, for example, stopping the operation of the compressor 1 on the basis of the measured oil concentration disturbs the efficiency of the operation of the compressor 1.

In Embodiment 3, consequently, the cylindrical electrode 30 is divided in the axial direction into a plurality of electrodes, to further improve the accuracy of measuring the oil concentration in the mixed liquid located at the position to be sucked up by the oil pump 19, and also the accuracy of measuring the liquid level of the mixed liquid, and the oil concentration distribution of the mixed liquid in the axial direction of the spindle 17.

[Configuration of Compressor]

Figure 13:
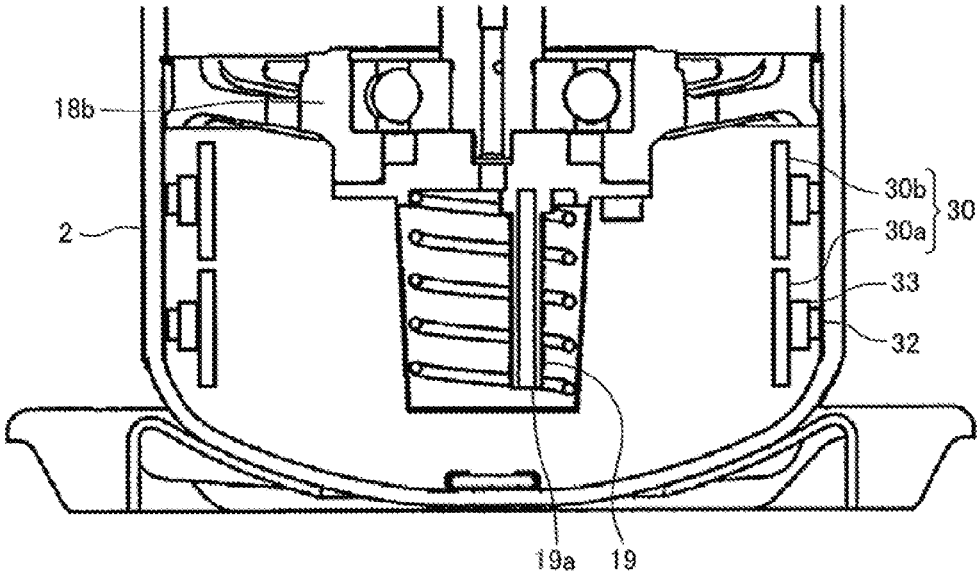
FIG. 13 is a schematic front sectional view illustrating a main part of a compressor according to Embodiment 3 of the present invention.

FIG. 13 is a schematic front sectional view illustrating a main part of the compressor 1 according to Embodiment 3 of the present invention. FIG. 13 illustrates, as in Embodiments 1 and 2, an example where the scroll compressor is employed as the compressor 1. The same components as those of the compressor 1 of Embodiments 1 and 2 will be given the same reference sign, and the detailed description of the components will be omitted.

Embodiment 3 is different from Embodiment 2, in that the cylindrical electrode 30 is divided in the axial direction into a plurality of electrodes.

As illustrated in FIG. 13, the cylindrical electrode 30 is divided, in the axial direction of the spindle 17, into a first cylindrical electrode 30*a* and a second cylindrical electrode 30*b*, which are insulated from each other.

The first cylindrical electrode 30*a* is located at the same height as the inlet port 19*a* of the oil pump 19. An electrode wire is connected to the first cylindrical electrode 30*a*, and to the sealed terminal 5.

The second cylindrical electrode 30*b* is located above the first cylindrical electrode 30*a*. An electrode wire is connected to the second cylindrical electrode 30*b*, and to the sealed terminal 5.

Thus, the oil concentration in the mixed liquid located between the first cylindrical electrode 30*a* and the shell 2, and the oil concentration in the mixed liquid located between the second cylindrical electrode 30*b* and the shell 2 can be individually measured by the oil concentration measuring unit 41.

The first cylindrical electrode 30*a* and the second cylindrical electrode 30*b* may be the same, or different, in shape.

The control unit 42 measures the liquid level and the oil concentration distribution of the mixed liquid stored in the reservoir 6, on the basis of the oil concentration of the mixed liquid measured by the first cylindrical electrode 30*a* and the oil concentration of the mixed liquid measured by the second cylindrical electrode 30*b*.

[Mounting Structure of Cylindrical Electrode]

NINTH MOUNTING EXAMPLE

The mounting structure of the first cylindrical electrode 30*a* and the second cylindrical electrode 30*b* in the shell 2 will be described below.

FIG. 13 illustrates a ninth mounting example of the first cylindrical electrode 30*a* and the second cylindrical electrode 30*b*. In the ninth mounting example, as illustrated in FIG. 13, one or a plurality of pedestals 32 are fixed to the inner wall of the shell 2. Then, the first cylindrical electrode 30*a* and the second cylindrical electrode 30*b* are attached to the pedestals 32 such that the non-conductive units 33 each are between the first cylindrical electrode 30*a* and one of the pedestals 32 and between the second cylindrical electrode 30*b* and another one of the pedestals 32. The first cylindrical electrode 30*a* and the second cylindrical electrode 30*b* can thus be mounted inside the shell 2.

TENTH MOUNTING EXAMPLE

Figure 14:
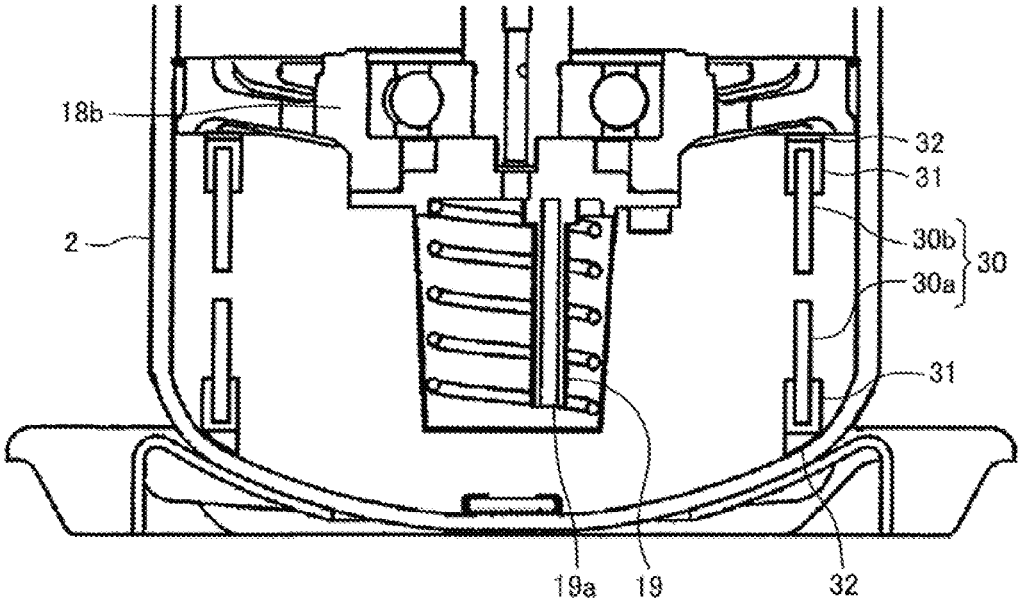
FIG. 14 is a schematic view illustrating a tenth mounting example of a first cylindrical electrode 30*a* and a second cylindrical electrode 30*b* in the compressor according to Embodiment 3 of the present invention.

FIG. 14 is a schematic view illustrating a tenth mounting example of the first cylindrical electrode 30*a* and the second cylindrical electrode 30*b*, in the compressor 1 according to Embodiment 3 of the present invention.

In the tenth mounting example, as illustrated in FIG. 14, one or a plurality of the electrode supporters 31 are attached to the first cylindrical electrode 30*a*, to hold the lower end portion of the first cylindrical electrode 30*a*. In addition, one or a plurality of pedestals 32 of which number corresponds to the number of the electrode supporters 31 are fixed to the bottom portion of the shell 2, and the electrode supporters 31 are fixed to the pedestals 32.

Then, one or a plurality of the electrode supporters 31 are attached to the second cylindrical electrode 30*b*, to hold the upper end portion of the second cylindrical electrode 30*b*. In addition, one or a plurality of pedestals 32 of which number corresponds to the number of the electrode supporters 31 are fixed to the lower portion of the sub bearing unit 18*b*, and the electrode supporters 31 are fixed to the pedestals 32.

The first cylindrical electrode 30*a* and the second cylindrical electrode 30*b* can thus be mounted inside the shell 2.

[Measurement of Liquid Level and Oil Concentration Distribution]

Description will be given below regarding the measurement of the liquid level and the oil concentration distribution of the mixed liquid, performed by the refrigerant compressing apparatus 100 according to Embodiment 3.

In the refrigerant compressing apparatus 100 according to Embodiment 3, the first cylindrical electrode 30*a* and the second cylindrical electrode 30*b* each measure the oil concentration in the mixed liquid located at the corresponding position. Then, the liquid level and the oil concentration distribution of the mixed liquid are measured on the basis of each of the values of the oil concentration.

Here, the state of the mixed liquid stored in the reservoir 6 can be classified into a first to a seventh state, on the basis of the oil concentration at the position where the first cylindrical electrode 30*a* is provided (hereinafter, "position A") and at the position where the second cylindrical electrode 30*b* is provided (hereinafter, "position B"). The control unit 42 measures the liquid level and the oil concentration distribution of the mixed liquid corresponding to the classified states. In addition, the control unit 42 controls the operation of the compressor 1 corresponding to the measurement result.

In the following description, the expression that "oil concentration is high" refers to a state where the sliding portions can be sufficiently lubricated, and that the oil concentration is, for example, higher than the second concentration.

The first state refers to a state where the oil concentration is high, at both of the position A and the position B.

In this case, as the oil concentration in the mixed liquid has been measured at both of the position A and the position B, it can be detected that the liquid level of the mixed liquid is equal to or higher than the lower end of the second cylindrical electrode 30*b*. In addition, as the oil concentration is high at both of the position A and the position B, it can be detected that a high ratio of refrigerating machine oil is contained in the mixed liquid, and that the refrigerating machine oil is substantially uniformly distributed in the mixed liquid.

The second state refers to a state where the oil concentration of the position A is high, and the oil concentration of the position B corresponds to a value of the refrigerant gas.

In this case, as the oil concentration in the mixed liquid has been measured only at the position A, it can be detected that the liquid level of the mixed liquid is lower than the lower end of the second cylindrical electrode 30*b*. In addition, as the oil concentration of the position A is high, it can be detected that a high ratio of refrigerating machine oil is contained in the mixed liquid, and that the refrigerating machine oil is substantially uniformly distributed in the mixed liquid.

The third state refers to a state where the oil concentration of the position A is high, and the oil concentration of the position B is low.

In this case, as the oil concentration in the mixed liquid has been measured at both of the position A and the position B, it can be detected that the liquid level of the mixed liquid is equal to or higher than the lower end of the second cylindrical electrode 30*b*. In addition, as the oil concentration of the position A is higher than that of the position B, it can be detected that the refrigerating machine oil is unevenly distributed in the lower portion of the mixed liquid.

The fourth state refers to a state where the oil concentration of the position A is low, and the oil concentration of the position B corresponds to a value of the refrigerant gas.

In this case, as the oil concentration in the mixed liquid has been measured only at the position A, it can be detected that the liquid level of the mixed liquid is lower than the lower end of the second cylindrical electrode 30*b*. In addition, as the oil concentration of the position A is low, it can be detected that a low ratio of refrigerating machine oil is contained in the mixed liquid, and that the refrigerating machine oil is substantially uniformly distributed in the mixed liquid.

The fifth state refers to a state where the oil concentration of the position A is low, and the oil concentration of the position B is high.

In this case, as the oil concentration in the mixed liquid has been measured at both of the position A and the position B, it can be detected that the liquid level of the mixed liquid is equal to or higher than the lower end of the second cylindrical electrode 30*b*. In addition, as the oil concentration of the position A is lower than that of the position B, it can be detected that the refrigerating machine oil is unevenly distributed in the upper portion of the mixed liquid.

The sixth state refers to a state where the oil concentration is low, at both of the position A and the position B.

In this case, as the oil concentration in the mixed liquid has been measured at both of the position A and the position B, it can be detected that the liquid level of the mixed liquid is equal to or higher than the lower end of the second cylindrical electrode 30*b*. In addition, as the oil concentration is low at both of the position A and the position B, it can be detected that a low ratio of refrigerating machine oil is contained in the mixed liquid, and that the refrigerating machine oil is substantially uniformly distributed in the mixed liquid.

The seventh state refers to a state where the oil concentration corresponds to a value of the refrigerant gas, at both of the position A and the position B.

In this case, as the oil concentration in the mixed liquid has been measured at neither of the position A and the position B, it can be detected that the mixed liquid has run out. In addition, as the mixed liquid has run out, the distribution of the refrigerating machine oil is unable to be measured.

In the first state and the second state, as the oil concentration in the mixed liquid is high at the position A, it is harmless to suck up the mixed liquid with the oil pump 19. In this case, consequently, there is no need to perform, for example, stopping the operation of the compressor 1, or reducing the liquid-back amount.

In the third state, although the liquid refrigerant is mixed in the refrigerating machine oil, for example, with transitional liquid-back, as the liquid refrigerant is unevenly distributed in the upper portion, it is harmless to suck up the mixed liquid with the oil pump 19. Consequently, there is no need to stop the operation of the compressor 1, however the liquid-back amount has to be reduced.

In the fourth state and the sixth state, the liquid refrigerant is mixed in the refrigerating machine oil, for example, with transitional liquid-back, and the ratio of the refrigerating machine oil is low. Thus, sucking up the mixed liquid with the oil pump 19 disables the sliding portions from being properly lubricated. In this case, consequently, the liquid-back amount has to be reduced, and the flow rate of the oil returning to the compressor 1 has to be increased. In case that the oil concentration in the mixed liquid fails to be improved even after the control is performed, the operation of the compressor 1 has to be stopped.

In the fifth state, the liquid refrigerant is mixed in the refrigerating machine oil, for example, with transitional liquid-back, and the liquid refrigerant is unevenly distributed in the lower portion. Thus, sucking up the mixed liquid with the oil pump 19 disables the sliding portions from being properly lubricated. In this case, consequently, the reduction of the liquid-back amount, discharging of the liquid refrigerant, or the stopping of the operation of the compressor 1 has to be executed.

The discharging of the liquid refrigerant will be described later with reference to Embodiment 4.

To improve the oil concentration in the mixed liquid, a different method may be adopted. For example, the reduction of the liquid-back amount, discharging of the liquid refrigerant, and the stopping of the operation of the compressor 1 liquid-back amount may be sequentially executed.

To be more detailed, first the liquid-back amount is reduced, and then the oil concentration in the mixed liquid is measured at the position A. In case that the oil concentration in the mixed liquid has not been improved as a result of the measurement, the liquid refrigerant is discharged, and then the oil concentration in the mixed liquid is measured at the position A and the position B. In case that, as a result of the measurement, the oil concentration of the position B corresponds to a value of the refrigerant gas, and the oil concentration in the mixed liquid at the position A has not been improved, the operation of the compressor 1 is stopped.

Then, the liquid refrigerant is gasified by heating, for example, with a belt heater or by restrained energization, and then the oil concentration in the mixed liquid is measured at the position A. In the case where the oil concentration in the mixed liquid has increased as a result of the measurement, the operation of the compressor 1 is resumed.

In the seventh state, as the mixed liquid has run out, the oil pump 19 is unable to suck up the mixed liquid. In this case, consequently, the operation of the compressor 1 has to be stopped.

In Embodiment 3, as described above, the cylindrical electrode 30 is divided into the first cylindrical electrode 30*a* and the second cylindrical electrode 30*b*, and the first cylindrical electrode 30*a* is located at the height corresponding to the height of the inlet port 19*a* of the oil pump 19.

Thus, in terms of the oil concentration, the mixed liquid located between the first cylindrical electrode 30*a* and the shell 2 is the same as the mixed liquid actually sucked up through the inlet port 19*a* of the oil pump 19. Thus, the oil concentration measuring unit 41 measures the oil concentration in the mixed liquid that is sucked up by the oil pump 19, and consequently, the accuracy of measuring the oil concentration in the mixed liquid can be further improved.

In Embodiment 3, further, the cylindrical electrode 30 is divided into the first cylindrical electrode 30*a* and the second cylindrical electrode 30*b*, and each of these electrodes individually detects whether the mixed liquid is present at the corresponding height. Such a configuration contributes to further improving the accuracy of measuring the liquid level and the oil concentration distribution of the mixed liquid stored in the reservoir 6.

Embodiment 4

A compressor according to Embodiment 4 of the present invention will be described below.

The typical liquid refrigerant has a heavier specific gravity than the refrigerating machine oil, and consequently, in the mixed liquid stored in the reservoir 6, the mixed liquid residing in the bottom portion has a lower oil concentration than the mixed liquid residing in the upper portion.

In Embodiment 4, consequently, the mixed liquid residing in the bottom portion of the reservoir 6 is directly drained out, to increase the oil concentration in the mixed.

[Configuration of Compressor]

Figure 15:
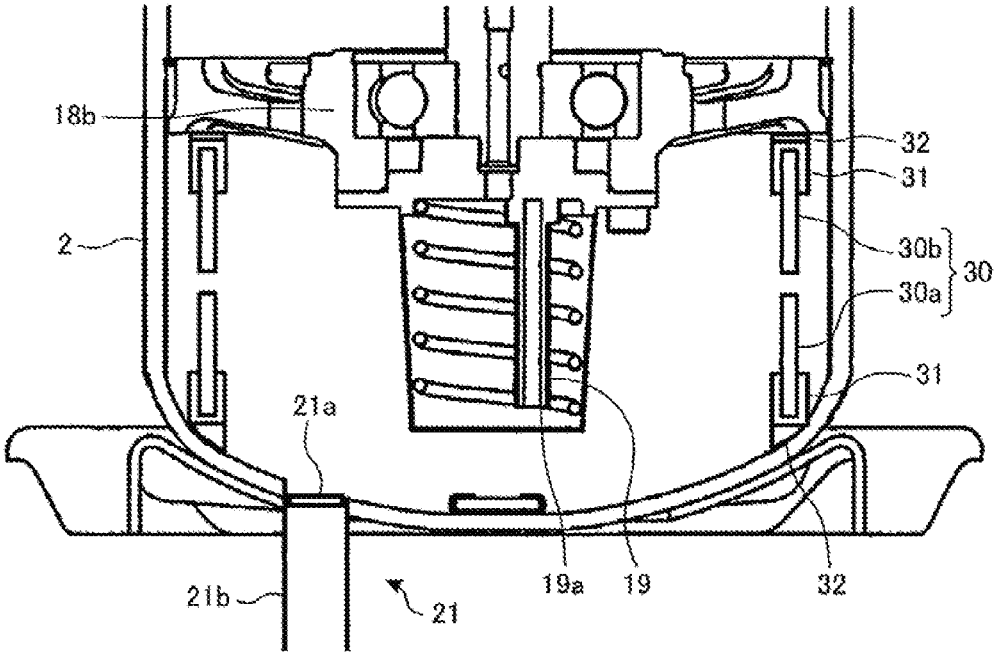
FIG. 15 is a schematic front sectional view illustrating a main part of a compressor according to Embodiment 4 of the present invention.

FIG. 15 is a schematic front sectional view illustrating a main part of the compressor 1 according to Embodiment 4 of the present invention. FIG. 15 illustrates, as in Embodiments 1 to 3, an example where the scroll compressor is employed as the compressor 1. The same components as those of the compressor 1 of Embodiments 1 to 3 will be given the same reference sign, and the detailed description of the components will be omitted.

Embodiment 4 is different from Embodiment 3, in that an oil drain device 21 for draining out the mixed liquid is provided in the bottom portion of the reservoir 6.

As illustrated in FIG. 15, the compressor 1 according to Embodiment 4 includes the oil drain device 21 located on the bottom face of the reservoir 6.

The oil drain device 21 includes an opening-closing device 21*a* and an oil drain pipe 21*b*.

The opening-closing device 21*a* controls the discharging of the mixed liquid stored in the reservoir 6 to outside, by opening and closing actions. The opening and closing of the opening-closing device 21*a* is controlled by the control unit 42.

The oil drain pipe 21*b* is a pipe for passing the mixed liquid discharged to outside, and connected to a non-illustrated oil separator.

The control unit 42 controls the oil drain device 21, to adjust the oil concentration in the mixed liquid stored in the reservoir 6. The control unit 42 stores a third concentration, predetermined as a threshold of the oil concentration in the mixed liquid, in the memory 42*a*.

The third concentration is provided as a threshold for increasing the oil concentration in the mixed liquid, and corresponds to a state where a higher ratio of liquid refrigerant is contained in the mixed liquid, compared with the refrigerating machine oil. As a specific example, the third concentration may be set to 30%.

The control unit 42 compares the oil concentration indicated oil by the information received from the oil concentration measuring unit 41 and the third concentration and, for example, opens the opening-closing device 21*a* of the oil drain device 21, when the oil concentration in the mixed liquid is equal to or lower than the third concentration.

[Oil Concentration Adjustment]

Description will be given below regarding the oil concentration adjustment process, performed by the refrigerant compressing apparatus 100 that includes the compressor 1 according to Embodiment 4.

Figure 16:
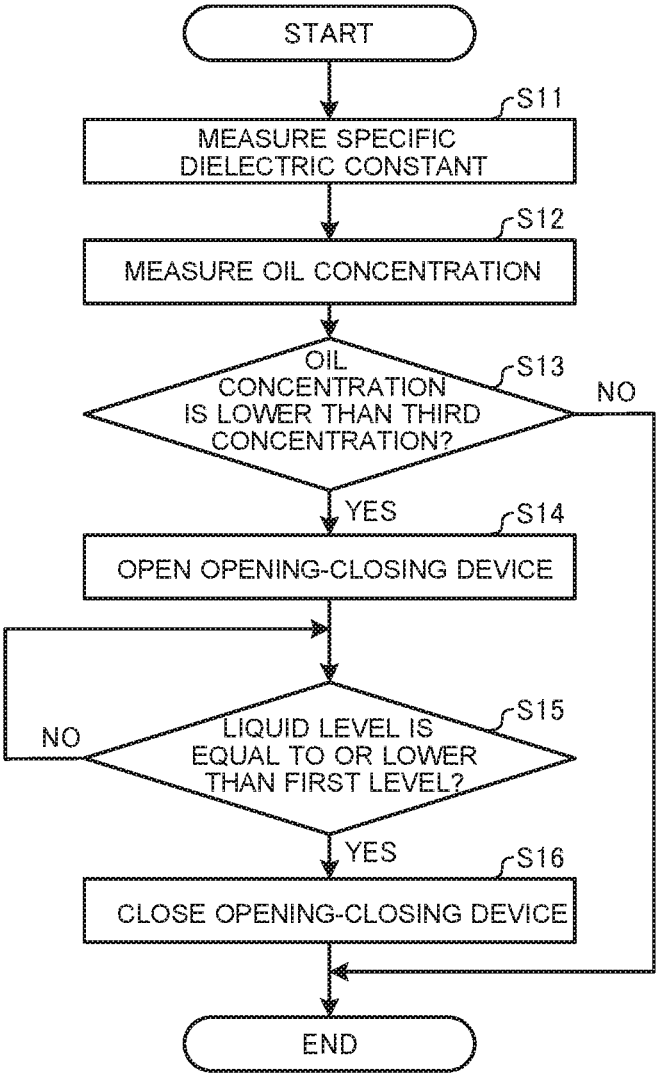
FIG. 16 is a flowchart illustrating an example of an oil concentration adjustment process performed by the refrigerant compressing apparatus including the compressor illustrated in FIG. 15.

FIG. 16 is a flowchart illustrating an example of the oil concentration adjustment process, performed by the refrigerant compressing apparatus 100 including the compressor 1 illustrated in FIG. 15.

First, at step S11, the specific dielectric constant measuring unit 40 measures, as in step S1 of FIG. 8, the specific dielectric constant of the mixed liquid stored in the reservoir 6, on the basis of the electrostatic capacitance between the shell 2 and the first cylindrical electrode 30*a*, and the electrostatic capacitance between the shell 2 and the second cylindrical electrode 30*b*. Then, the specific dielectric constant measuring unit 40 sends the information indicating the measured specific dielectric constant to the oil concentration measuring unit 41.

At step S12, the oil concentration measuring unit 41 measures, as in step S2 of FIG. 8, the oil concentration in the mixed liquid, on the basis of the specific dielectric constant indicated by the information received from the specific dielectric constant measuring unit 40. The oil concentration measuring unit 41 then sends the information indicating the measured oil concentration to the control unit 42.

At step S13, the control unit 42 compares the oil concentration indicated by the information received from the oil concentration measuring unit 41 and the third concentration stored in the memory 42*a*.

When the control unit 42 determines that the oil concentration is lower than the third concentration as a result of the comparison (YES at step S13), the control unit 42 opens the opening-closing device 21*a*, at step S14.

In contrast, when the control unit 42 determines that the oil concentration is equal to or higher than the third concentration (NO at step S13), the series of the process is finished.

At step S15, the control unit 42 determines whether the liquid level of the mixed liquid is equal to or lower than a first level.

Here, the first level refers to a level slightly higher than the inlet port 19*a* of the oil pump 19.

In this case, the control unit 42 determines that the liquid level of the mixed liquid is equal to or lower than the first level, for example, from the fact that the liquid level has been measured on the basis of the specific dielectric constant measured by the first cylindrical electrode 30*a*, and that the liquid level has not been measured on the basis of the specific dielectric constant measured by the second cylindrical electrode 30*b*.

When the control unit 42 determines that the liquid level of the mixed liquid is equal to or lower than the first level (YES at step S15), the control unit 42 closes the opening-closing device 21*a*, at step S16.

In contrast, when the control unit 42 determines that the liquid level of the mixed liquid is higher than the first level (NO at step S15), the process returns to step S15, and the control unit 42 repeats the process of step S15, until the liquid level falls to a level equal to or lower than the first level.

Here, the mixed liquid discharged from the reservoir 6 is connected to, for example, the non-illustrated oil separator, and separated into the liquid refrigerant and the refrigerating machine oil, out of which the refrigerating machine oil is returned to the compressor 1.

As described above, when the oil concentration in the mixed liquid stored in the reservoir 6 is lower than the third concentration, the oil concentration in the mixed liquid can be adjusted to increase, by discharging the mixed liquid, in particular the part of the mixed liquid having a lower oil concentration, to outside.

Further, the refrigerating machine oil is separated from the mixed liquid discharged outside, and returned to the compressor 1. Consequently, the oil concentration in the mixed liquid can be further increased.

In Embodiment 4, as described above, the oil drain device 21 is provided on the bottom face of the reservoir 6, and a part of the stored mixed liquid, in particular the part of the stored mixed liquid having a lower oil concentration, is discharged to outside, when the oil concentration in the mixed liquid stored in the reservoir 6 is lower than the third concentration. Consequently, the oil concentration in the mixed liquid can be adjusted to increase.

In addition, as the refrigerating machine oil contained in the mixed liquid discharged to outside is returned to the compressor 1, the oil concentration in the mixed liquid can be further increased.

While Embodiments 1 to 4 of the present invention have been described as above, it should be noted that the present invention is not limited to Embodiments 1 to 4, but may be modified in various manners within the scope of the present invention.

For example, while the oil concentration measuring unit 41 and the control unit 42 are independent components in Embodiments 1 to 4, the oil concentration measuring unit 41 and the control unit 42 may be unified such that the control unit 42 also is provided with a function to measure the oil concentration in the mixed liquid.

In addition, while the compressor 1 is exemplified by the scroll compressor in Embodiments 1 to 4, the compressor 1 may be, for example, a reciprocating compressor or a rotary compressor.

Further, while the electrode wire connected to the cylindrical electrode 30 is led to outside through the sealed terminal 5 in Embodiments 1 to 4, a sealed terminal different from the sealed terminal 5 may be provided on the shell 2 at a position close to the cylindrical electrode 30, to lead out the electrode wire through such sealed terminal.

The invention claimed is:

1. A refrigerant compressing apparatus comprising:

a compressor including:

a compression mechanism configured to compress refrigerant, an electromotive mechanism configured to drive the compression mechanism, a shell that is formed of a conductive material and accommodating the compression mechanism and the electromotive mechanism inside a cylindrical inner surface of the shell in a radial direction, a reservoir that is provided inside the shell and configured to store a mixed liquid, including a liquid refrigerant and a refrigerating machine oil, an electrode being a cylindrical electrode, wherein the electrode and the shell together constitute a double electrode, the shell adapted to function as an outer electrode of the double electrode, which is configured to measure dielectric characteristics of the mixed liquid located between the electrode and the cylindrical inner surface of the shell, the electrode, which is being provided inside the reservoir, is directly facing the cylindrical inner surface of the shell and being electrically isolated from the shell, a spindle, including an oil passage formed inside the spindle, is being driven by the electromotive mechanism, an inlet port is provided in the reservoir to suck up the mixed liquid to the oil passage, which is formed inside the spindle, and a lower end of the electrode which is the cylindrical electrode is at least as high as the inlet port, and a controller connected directly or indirectly to the double electrode, the controller comprising a processor and/or hardware circuit configured to:

measure, in order to measure dielectric properties, a specific dielectric constant of the mixed liquid located between the cylindrical electrode and the cylindrical inner surface of the outer electrode on a basis of a predetermined electrostatic capacitance based on a distance between the cylindrical inner surface of the outer electrode and the cylindrical electrode, and a surface area of the cylindrical electrode.

2. The refrigerant compressing apparatus of claim 1 further comprising:

a main bearing unit supporting an upper end portion of the spindle; and a sub bearing unit provided inside the reservoir and supporting a lower end portion of the spindle, wherein the cylindrical electrode is located above the sub bearing unit.

3. The refrigerant compressing apparatus of claim 1 further comprising an oil pump provided inside the reservoir having the inlet port to suck up the mixed liquid, wherein the cylindrical electrode is located to surround the oil pump.

4. The refrigerant compressing apparatus of claim 3, wherein the cylindrical electrode includes a first cylindrical electrode located at a height of the inlet port of the oil pump, the first cylindrical electrode and the shell together constitute a first double electrode, and a second cylindrical electrode located directly above the first cylindrical electrode, to be insulated from the first cylindrical electrode, the second cylindrical electrode and the shell together constitute a second double electrode.

5. The refrigerant compressing apparatus of claim 1, wherein the cylindrical electrode is located to surround the inlet port.

6. The refrigerant compressing apparatus of claim 5, wherein the cylindrical electrode includes a first cylindrical electrode located at a height of the inlet port, the first cylindrical electrode and the shell together constitute a first double electrode, and a second cylindrical electrode located directly above the first cylindrical electrode, to be insulated from the first cylindrical electrode, the second cylindrical electrode and the shell together constitute a second double electrode.

7. The refrigerant compressing apparatus of claim 1 further comprising:

a sub bearing unit provided inside the reservoir and supporting a lower end portion of the spindle, wherein the cylindrical electrode is located inside the reservoir such that one of an upper end portion and a lower end portion of the cylindrical electrode is supported by an electrode supporter formed of a non-conductive material, and the electrode supporter is fixed to at least one of a lower end of the electromotive mechanism, the cylindrical inner surface of the shell, a bottom face of the shell, and the sub bearing unit.

8. The refrigerant compressing apparatus of claim 1, wherein the cylindrical electrode is located inside the reservoir such that the cylindrical electrode is fixed to the cylindrical inner surface of the shell and a non-conductive unit is provided between the cylindrical electrode and the inner surface.

9. The refrigerant compressing apparatus of claim 1, wherein the controller is further configured to:

measure, on a basis of the specific dielectric constant that is measured, an oil concentration indicating a ratio of the refrigerating machine oil in the mixed liquid; and control, on a basis of the oil concentration that is measured, at least one of an operation of the compressor and a flow rate of the refrigerant in a refrigerant circuit to which the compressor is connected.

10. The refrigerant compressing apparatus of claim 9, wherein the compressor includes an oil drain with a pipe located in a bottom portion of the reservoir, the oil drain including an opening-closing valve to be opened and closed to discharge the mixed liquid via the pipe to outside, and the controller is configured to adjust the oil concentration in the mixed liquid, by opening and closing the opening-closing valve of the oil drain.

11. The refrigerant compressing apparatus of claim 9, wherein the controller is configured to measure the oil concentration on a basis of oil concentration information indicating a relation between the specific dielectric constant and the oil concentration, and the specific dielectric constant that is measured, and the controller is configured to stop an operation of the compressor, when the oil concentration that is measured is equal to or lower than a predetermined first concentration, and control a flow rate of the refrigerant flowing in the refrigerant circuit, when the oil concentration that is measured is equal to or lower than a predetermined second concentration that is higher than the predetermined first concentration.

12. The refrigerant compressing apparatus of claim 9, wherein the controller is configured to measure a liquid level of the mixed liquid on a basis of the oil concentration that is measured.

13. The refrigerant compressing apparatus of claim 9, wherein the electrode is located to surround the inlet port, the electrode includes a first cylindrical electrode having the lower end located at a height of the inlet port, the first cylindrical electrode and the shell together constitute a first double electrode, and a second cylindrical electrode located directly above the first electrode, to be insulated from the first electrode, the second cylindrical electrode and the shell together constitute a second double electrode, and the controller is configured to measure a liquid level of the mixed liquid stored in the reservoir on a basis of the oil concentration in the mixed liquid measured by the first cylindrical electrode and the oil concentration in the mixed liquid measured by the second cylindrical electrode.

14. The refrigerant compressing apparatus of claim 9, wherein the electrode is located to surround the inlet port, the electrode includes a first cylindrical electrode having the lower end located at a height of the inlet port, the first cylindrical electrode and the shell together constitute a first double electrode, and a second cylindrical electrode located directly above the first electrode, to be insulated from the first electrode, the second cylindrical electrode and the shell together constitute a second double electrode, and the controller is configured to measure an oil concentration distribution of the mixed liquid stored in the reservoir on a basis of the oil concentration in the mixed liquid measured by the first cylindrical electrode and the oil concentration in the mixed liquid measured by the second cylindrical electrode.

15. The refrigerant compressing apparatus of claim 10, wherein the controller is configured to open the opening-closing valve, when the oil concentration that is measured is lower than a predetermined third concentration, and close the opening-closing valve, when a liquid level of the mixed liquid stored in the reservoir is equal to or lower than a predetermined first level.

16. A refrigerating apparatus, comprising the refrigerant circuit sequentially connecting, by refrigerant pipes, the refrigerant compressing apparatus of claim 9, a heat source-side heat exchanger, an expansion valve, and a use-side heat exchanger, the refrigerant circuit being configured to circulate refrigerant.

17. The refrigerating apparatus of claim 16, further comprising:

a bypass circuit connecting a point between the heat source-side heat exchanger and the expansion valve, and a point between the use-side heat exchanger and the compressor; and an expansion device provided in the bypass circuit and configured to adjust a flow rate of the refrigerant in accordance with a signal received from the controller.

18. The refrigerant compressing apparatus of claim 1, wherein the controller is further configured to:

measure, on a basis of the specific dielectric constant that is measured, an oil concentration indicating a ratio of the refrigerating machine oil in the mixed liquid; and control, on a basis of the oil concentration that is measured, at least one of an operation of the compressor and a flow rate of the refrigerant in a refrigerant circuit to which the compressor is connected.

* * * * *